US007437119B2

(12) United States Patent
Takemoto et al.

(10) Patent No.: US 7,437,119 B2
(45) Date of Patent: Oct. 14, 2008

(54) IMAGE FORMING APPARATUS AND FEEDING TRAY

(75) Inventors: Takatoshi Takemoto, Nagoya (JP); Tetsuo Asada, Kuwana (JP); Yoshiaki Imaeda, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 392 days.

(21) Appl. No.: 11/071,257

(22) Filed: Mar. 4, 2005

(65) Prior Publication Data

US 2005/0196212 A1 Sep. 8, 2005

(30) Foreign Application Priority Data

Mar. 5, 2004 (JP) ..... 2004-062647

(51) Int. Cl.
*G03G 15/00* (2006.01)

(52) U.S. Cl. ..... 399/393; 399/381

(58) Field of Classification Search ..... 399/393, 399/381

See application file for complete search history.

(56) References Cited

U.S. PATENT DOCUMENTS 4,780,740 A * 10/1988 Fukae ..... 399/86
5,019,839 A * 5/1991 Watanabe et al. ..... 346/134
5,346,197 A * 9/1994 Takano et al. ..... 271/9.05
5,596,399 A * 1/1997 Dempsey et al. ..... 399/45
5,932,313 A * 8/1999 Barton ..... 428/141
5,957,447 A * 9/1999 Sekine ..... 271/9.09
6,266,512 B1 * 7/2001 de Koning et al. ..... 399/370
6,419,410 B1 * 7/2002 Osmus et al. ..... 400/624
6,581,924 B2 * 6/2003 Gaarder et al. ..... 271/114
6,651,974 B2 11/2003 Kawarama et al.
6,951,428 B2 * 10/2005 Bingham et al. ..... 400/624
2001/0016138 A1 8/2001 Osmus
2004/0017038 A1 * 1/2004 Underwood et al. ..... 271/117

FOREIGN PATENT DOCUMENTS

EP 05 25 1296 5/2005
JP 7-11055 3/1995
JP 2002249242 9/2002
JP 2002321838 11/2002

* cited by examiner

*Primary Examiner*—Anthony H. Nguyen
(74) *Attorney, Agent, or Firm*—Banner & Witcoff, Ltd

(57) ABSTRACT

An image recording apparatus includes: a feeding tray; a side end guide provided on the feeding tray along a recording medium feeding direction and being capable of shifting in a direction orthogonal to the recording medium feeding direction; an arm member capable of swinging about a support shaft extending in an apparatus body in the direction orthogonal to the recording medium feeding direction; a feeding roller disposed on a swinging end side of the arm member; a cam portion provided on the side end guide and having a height from a bottom surface of the feeding tray which varies along the recording medium feeding direction; and a driven portion provided on the arm member which is brought into slide contact with the cam portion and displaced when the feeding tray is pulled out from or inserted into the apparatus body to cause a swing movement of the arm member.

24 Claims, 17 Drawing Sheets

IMAGE FORMING APPARATUS AND FEEDING TRAY

BACKGROUND OF THE INVENTION

1. Field of the Invention

The present invention relates to an image recording apparatus and a feeding tray.

2. Description of the Related Art

Hitherto, as an image recording apparatus such as a printer, a copying machine or a facsimile, having a detachable feeding tray on an apparatus body, transporting a sheet-type recording medium stacked on the feeding tray to an image recording unit by a feeding unit, and recording an image on the recording medium is known. JP-A-2002-249242 discloses such an image recording apparatus. The image recording apparatus disclosed in JP-A-2002-249242 includes an arm member, which is swingable about a support shaft provided on an apparatus body, and a feeding roller provided at a swinging end of the arm member, and is configured in such a manner that the feeding roller abuts against an uppermost recording medium stacked on the feeding tray and transports the recording medium toward an image recording unit by the rotation of the feeding roller.

In the apparatus configured as described above, it is necessary to prevent the feeding roller from being hit on an innermost wall of the feeding tray when the feeding tray is attached to or detached from the apparatus body. Therefore, in the image recording apparatus disclosed in JP-A-2002-249242, a cam portion having a predetermined inclined surface is formed on a side wall portion which is fixedly disposed on the feeding tray, so that the arm member is swung by being guided by the cam portion and the feeding roller climbs over the innermost wall of the feeding tray.

SUMMARY OF THE INVENTION

There is a feeding tray provided with a side end guide which can be shifted in a direction orthogonal to a recording medium feeding direction so that the recording media of various sizes can be positioned. When an attempt is made to add such the side end guide to the one disclosed in JP-A-2002-249242 described above, there arises a problem such that a fixed side wall formed with a cam portion must be provided further outside of the side end guide in a state in which the distance is expanded to the maximum possible width, and hence the width of the feeding tray increases correspondingly.

The present invention provides an image recording apparatus and a feeding tray, which can be downsized.

According to one aspect of the present invention, there is provided an image recording apparatus including: an apparatus body having a support shaft; a feeding tray being capable of accommodating a sheet-type recording medium stacked thereon and capable of being pulled out from and inserted into the apparatus body; a side end guide provided on the feeding tray along a recording medium feeding direction and being capable of shifting in a direction orthogonal to the recording medium feeding direction; an image recording unit provided in the apparatus body for recording an image on the recording medium; an arm member capable of swinging about the support shaft extending in the apparatus body in the direction orthogonal to the recording medium feeding direction; a feeding roller disposed on a swinging end side of the arm member and coming into abutment with an uppermost recording medium stacked on the feeding tray when the feeding tray is inserted into the apparatus body and transporting the same toward the image recording unit; a cam portion provided on the side end guide and having a height from a bottom surface of the feeding tray which varies along the recording medium feeding direction; and a driven portion provided on the arm member, the driven portion being brought into slide contact with the cam portion and displaced when the feeding tray is pulled out from or inserted into the apparatus body to cause a swing movement of the arm member.

According to another aspect of the present invention, there is provided a feeding tray used for an image recording apparatus having a main body and a feeding roller swingable about a support shaft, the feeding tray being capable of drawing out from and inserting into the main body and being capable of accommodating a plurality of sheet-type recording media stacked thereon, the feeding tray including: a side end guide provided along a recording medium feeding direction and being capable of shifting in a direction orthogonal to the recording medium feeding direction; and a swinging unit provided on the side end guide for swinging the feeding roller when the feeding tray is pulled out from or inserted into the apparatus body.

Since the cam portion (swinging unit) for lifting the feeding roller when the feeding tray is pulled out or inserted is provided on the side end guide, the side wall of the feeding tray can be omitted and the width of the feeding tray can be reduced correspondingly, thereby achieving downsizing of the apparatus.

BRIEF DESCRIPTION OF THE DRAWINGS

The present invention may be more readily described with reference to the accompanying drawings.

DETAILED DESCRIPTION OF THE PREFERRED EMBODIMENTS

Referring now to FIG. 1 to FIG. 12, an embodiment of the invention will be described.

Figure 1:
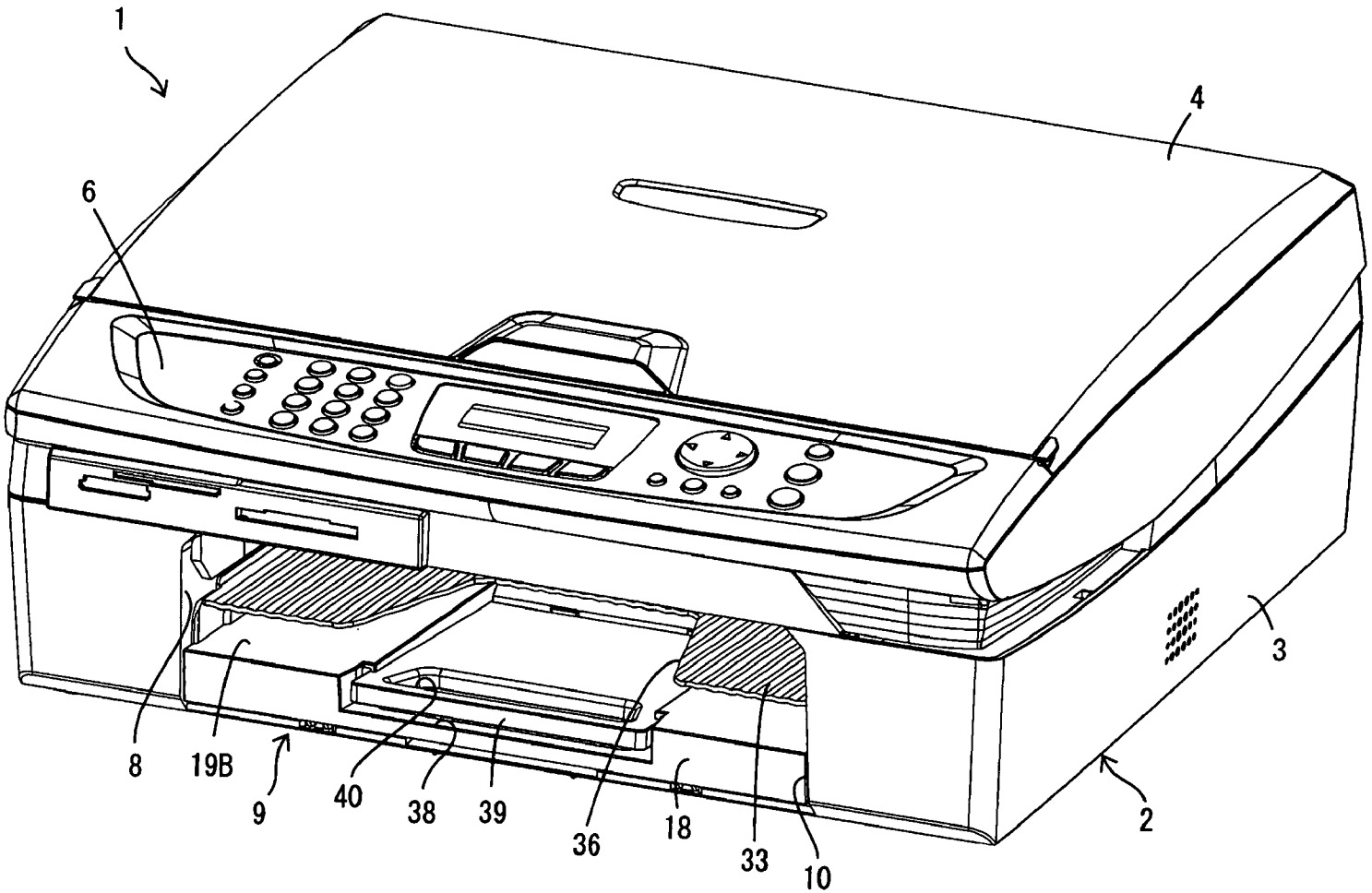
FIG. 1 is a perspective view of an appearance of an image recording apparatus according to an embodiment.
Figure 2:
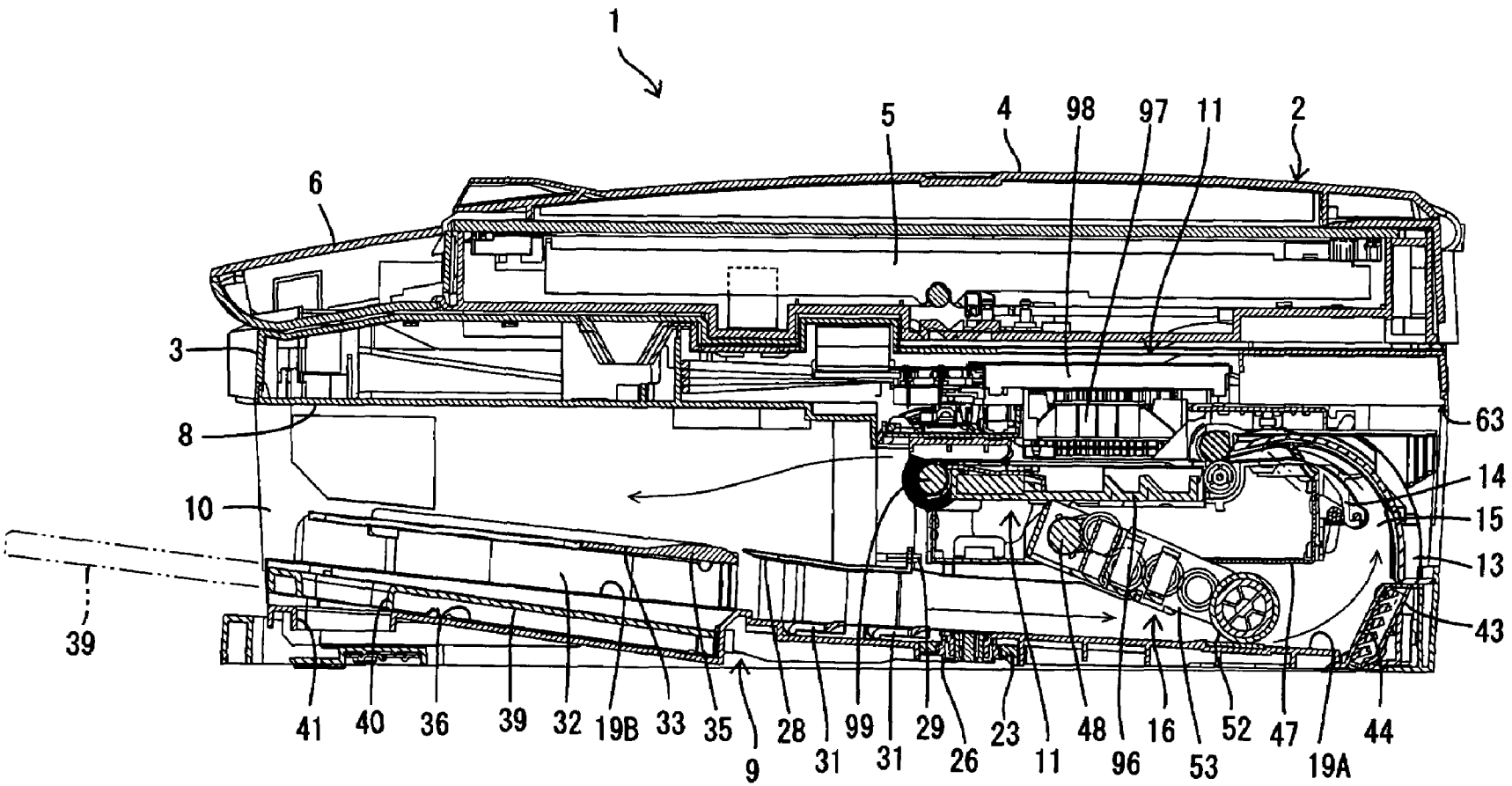
FIG. 2 is a cross-sectional view of the image recording apparatus.

FIG. 1 is a perspective view of an appearance of an image recording apparatus 1 according to the embodiment, and FIG. 2 is a cross-sectional view of the image recording apparatus 1. In the description shown below, the vertical direction is based on FIG. 2, and as regards the front and rear direction, the left side of FIG. 2 is the front.

The image recording apparatus 1 of the present embodiment is a multi function device having a facsimile function, a printing function, a copying function, and a scanning function. The image recording apparatus 1 has a substantially and generally box-shaped casing 2. The casing 2 has a substantially square shape, whereof the dimension of one side is slightly larger than the length of an A4 size sheet in plan view. The casing 2 has two-part structure, including an apparatus body 3 of substantially box shape, and a cover body 4 to be mounted thereon so as to cover the upper surface. The cover body 4 can be opened and closed with respect to the apparatus body 3, and is provided with a reading unit 5 for reading images, an operating panel 6, and so on.

The apparatus body 3 is provided with an opening 8 opening toward the front at the widthwise center thereof. The lower side of the opening 8 corresponds to a tray storage 10 for storing a feeding tray 9 which accommodates sheet-type recording media (not shown) such as sheet paper or OHP sheet, stacked thereon. Arranged on the inner side (rear side) of the opening 8 above the tray storage 10 is an image recording unit 11 for forming an image on the recording medium. On further inner side of the image recording unit 11, there are provided an outer arcuate guide 13 and an inner arcuate guide 14, and a U-shaped free passage 15 for connecting the distal end of the feeding tray 9 in the tray storage 10 and the rear end of the image recording unit 11 is formed between the arcuate guides 13, 14. Provided between the image recording unit 11 and the feeding tray 9 is a feeding unit 16 for feeding the recording medium on the feeding tray 9 toward the image recording unit 11. The image recording apparatus 1 is adapted to deliver the recording media stacked on the feeding tray 9 to the free passage 15 by the feeding unit 16 as indicated by an arrow in FIG. 2, allow the same to pass through the free passage 5 to the image recording unit 11, whereby a prescribed image is recorded thereon, and discharge it to the front upper surface of the feeding tray 9. In the apparatus body 3, there are provided a driving unit (not shown) for driving the feeding unit 16 and a control circuit (not shown) for controlling the action of each part.

The structure of each part will now be described in detail.

Figure 3:
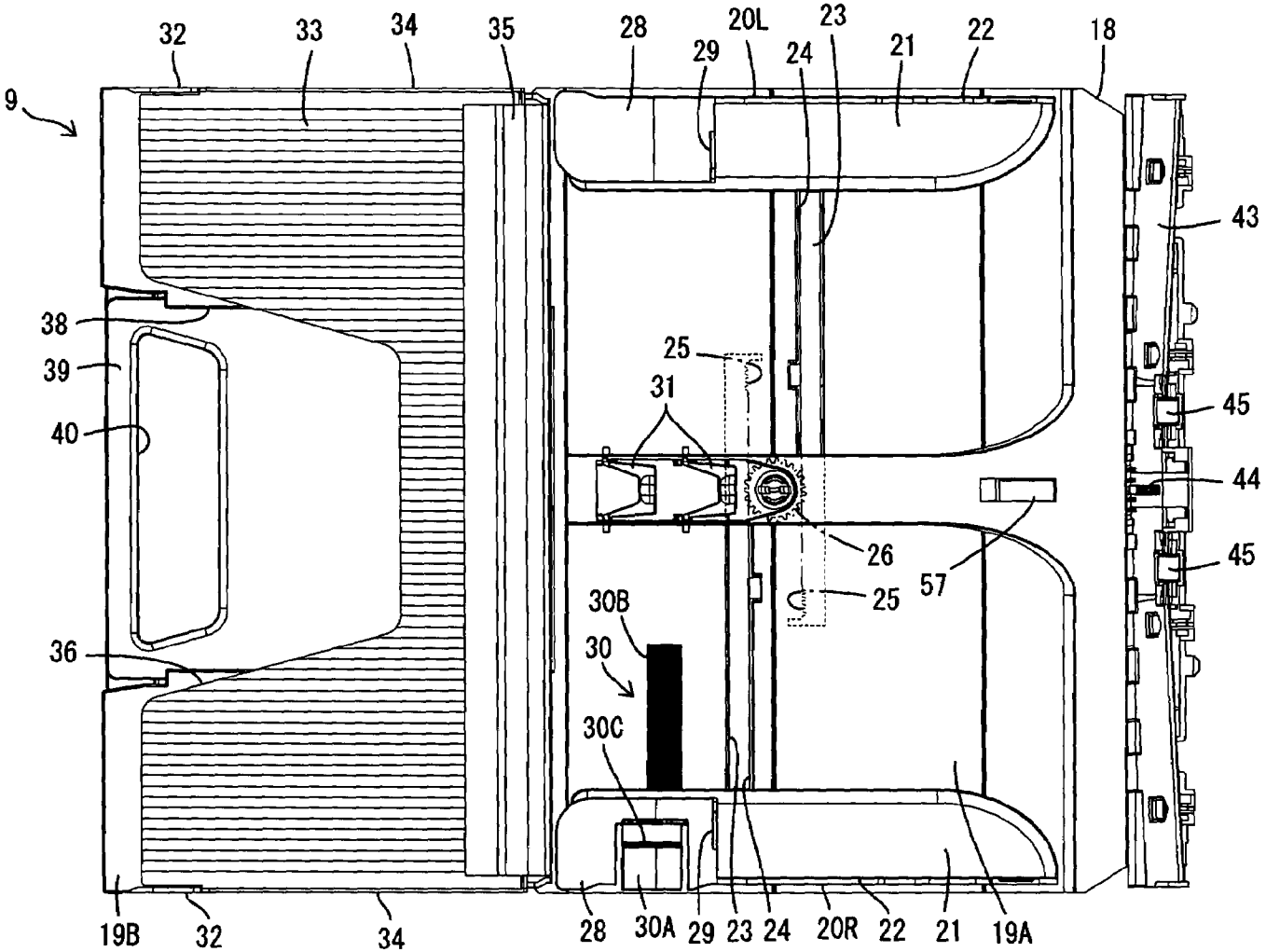
FIG. 3 is a plan view of a feeding tray.
Figure 4:
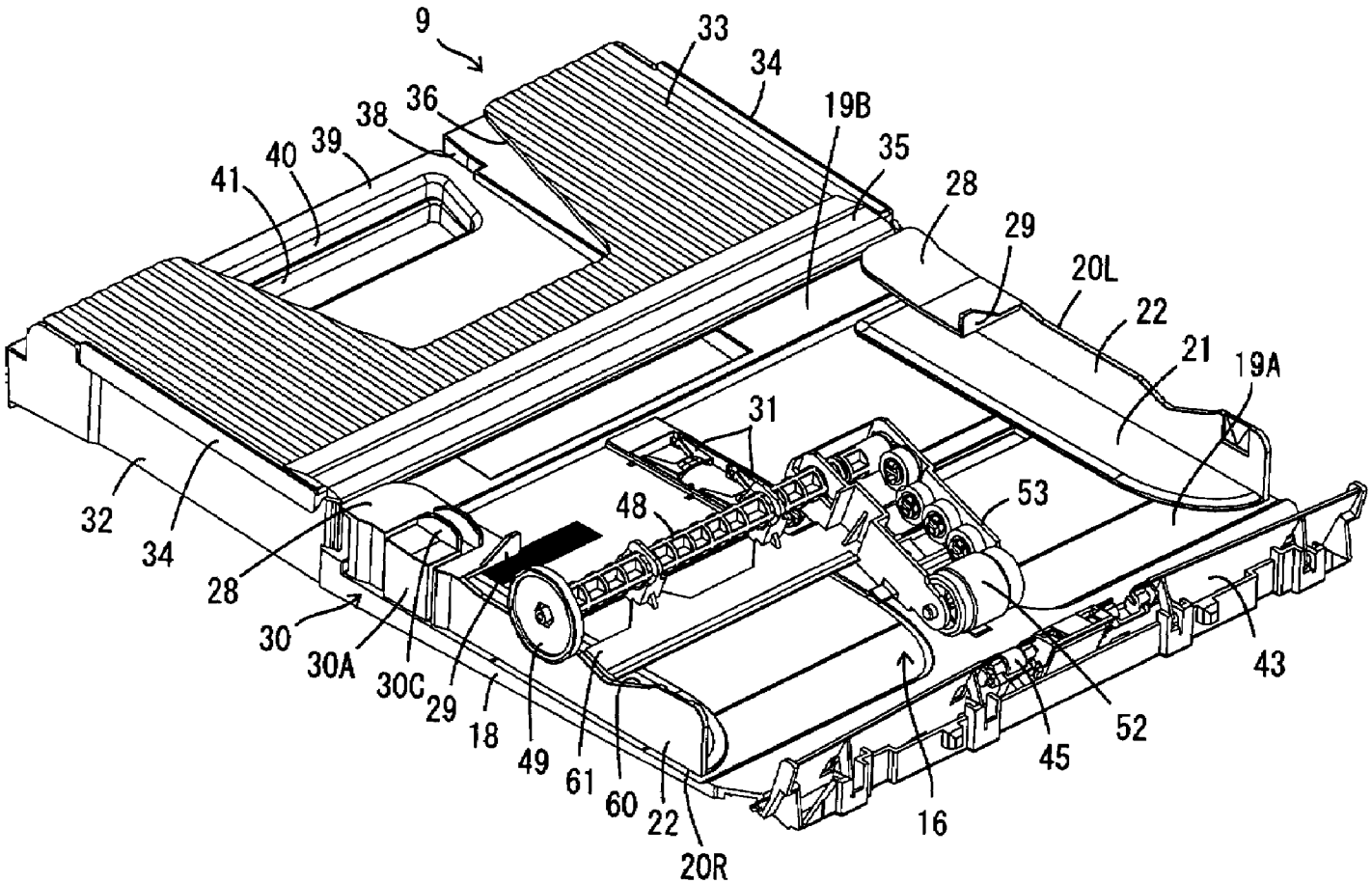
FIG. 4 is a perspective view of the feeding tray and a feeding unit.

Referring first to FIG. 3, FIG. 4, and so on, the feeding tray 9 will be described. FIG. 3 is a plan view of the feeding tray 9, and FIG. 4 is a perspective view of the feeding tray 9 and the feeding unit 16 provided on the side of the apparatus body 3. The feeding tray 9 can be removed from the apparatus body 3 by being pulled out horizontally from the aforementioned tray storage 10 toward the front, and can be stored again into the apparatus body 3 by inserting from the removed state horizontally into the tray storage 10. The feeding tray 9 is provided with a rectangular bottom plate 18 and is formed into a thin plate having dimensions of approximately A4 size generally in plan view. The bottom plate 18 can accommodate the recording media stacked on the upper surface thereof, and about rear half area of the upper surface corresponds to a rear stacking surface 19A and about a front half area corresponds to the front stacking surface 19B. The both stacking surfaces 19A, 19B are inclined so that the downstream sides in the recording medium feeding direction are lower, and the angle of inclination of the front stacking surface 19B is larger than that of the rear stacking surface 19A (see FIG. 2).

A pair of side end guides 20R, 20L are provided at a distant apart from each other on the left and right sides on the rear stacking surface 19A. The respective side end guides 20R, 20L are provided with bottom wall portions 21 along the rear stacking surface 19A from the position slightly forward of the rear end of the rear stacking surface 19A to the position near the front end of the rear stacking surface 19A. Guide walls 22 having the same length as the bottom wall portion 21 extend from the widthwise outer ends of the bottom plates 18 of the respective bottom wall portion 21 perpendicularly in the front and rear direction (that is, the recording medium feeding direction). Linear guide bars 23 extend from the bottom surfaces of the respective bottom wall portions 21 toward the other side end guides 20R, 20L. The both linear guide bars 23 are arranged in parallel at a predetermined distance from each other in the front and rear direction, and are fitted into grooves 24 provided along the respective bottom plates 18 in the lateral direction. The side end guides 20R, 20L are both capable of shifting in the lateral direction (that is, the direction orthogonal to the recording medium feeding direction) by bringing the bottom wall portions 21 into sliding contact with the rear stacking surface 19A and causing the linear guide bars 23 to slide along the grooves 24. The both linear guide bars 23 are formed with rack gears 25 on the portions opposing to each other, and the respective rack gears 25 engage with a pinion gear 26 rotatably provided at the widthwise center of the bottom plate 18. In this manner, the both side end guides 20R, 20L are connected to each other via the pinion gear 26 so as to be interlocked with each other to always maintain the distance from the both guide walls 22 to the widthwise center of the bottom plate 18 constant. When the distance between the side end guides 20R, 20L are expanded to the maximum width (the state in FIG. 3), the distance between both guide walls 22 is almost equivalent to the dimension of the shorter side (width) of the A4 size.

Above the bottom wall portions 21, overhanging portions 28 are extended from the upper ends of the guide walls 22 of the both side end guides 20R, 20L near the front end. The respective overhanging portions 28 are formed with stoppers 29 at the rear end so as to extend perpendicularly. These stoppers 29 are located below an discharge roller 99, described later, and restrain discharged recording medium to move from over the overhanging portions 28 rearward. A position adjusting member 30 for adjusting the both side end guides 20R, 20L to desired positions is provided at the front of the right side end guide 20R. The position adjusting member 30 includes a resilient strip 30A having an angular C-shape along the respective surfaces of the bottom wall portion 21, the guide wall 22, and the overhanging portion 28, whereby, in a state in which an external force is not applied on the resilient strip 30A, a locking projection (not shown) provided on the lower surface engages a rib-band 30B having a rough surface formed on the rear stacking surface 19A in the lateral direction to achieve registration. By gripping the operating tub 30*c* provided on the upper end of the resilient strip 30A, the resilient strip 30A is flexibly deformed, and engagement between the locking projection and the rib-band 30B is released, whereby the both side end guides 20R, 20L can be shifted in the lateral direction.

At the widthwise center of the rear stacking surface 19A, a pair of registration ribs 31, which can be moved between the upright position to the folded position, and when the registration ribs 31 are in the upright positions, recording media of postcard size or large-photo size can be positioned with respect to a guide plate 43, described later, provided at the rear end of the rear stacking surface 19A.

Fixed side walls 32 along the front and rear direction are provided on the bottom plate 18 at both side ends of the area corresponding to the front stacking surface 19B so as to project upright. The fixed side walls 32 are arranged so as to be aligned in substantially flush with the respective guide wall 22 when the distance between the both side end guides 20R, 20L is expanded to the maximum width. At the upper ends of the fixed side walls 32, there is provided a cover member 33 capable of covering the recording media stacked on the bottom plate 18 from above extended across the both fixed side walls 32. The cover member 33 is attached by fitting snapping edges 34 provided on both ends thereof to the upper ends of the respective fixed side walls 32 from above, and are detachable from the both fixed side walls 32. The cover member 33 is inclined downwardly toward the rear so as to be generally in parallel with the front stacking surface 19B as a whole. The upper surface of the cover member 33 is formed with an elevated portion 35 along the rear edge, and the height of the front end of the overhanging portions 28 of the respective side end guides 20R, 20L are the same as that of the elevated portion. Furthermore, the cover member 33 is formed at the widthwise center thereof with a notch 36 opening toward the front.

The front stacking surface 19B of the bottom plate 18 is formed at the widthwise center thereof with a rectangular supporting member storage hole 38 opening toward the front, and a plate-shaped auxiliary supporting member 39 of the same rectangular shape in plan view is mounted in the supporting member storage hole 38. The auxiliary supporting member 39 can be shifted in the front and rear direction, and is stored entirely in the supporting member storage hole 38 when not in use as shown in FIG. 2 by a solid line, and is pulled out toward the front by a predetermined length from the supporting member storage hole 38 as shown by two double-dashed line in FIG. 2 when in use. A laterally elongated finger hole 40 is formed at the front portion of the auxiliary supporting member 39 so as to penetrate therethrough in the vertical direction, and a second finger hole 41 is also provided on the bottom surface of the supporting member storage hole 38 at a position corresponding to the finger hole 40.

A guide plate 43 is mounted to the rear end of the bottom plate 18 over the entire width thereof, and the guide plate 43 is inclined at the front surface upward. When a feeding unit 16, described later, pushes a plurality of recording media stacked on the bottom plate 18 toward the guide plate 43, one of the recording media is separated and the leading edge of the recording medium is guided upward. The guide plate 43 is slightly bent in such a manner that the widthwise (lateral) center portion is protruded toward the front, and a metallic separating member 44 is attached so as to overlap with the protruded end at the center thereof. The separating member 44 includes a plurality of teeth arranged at predetermined intervals in the vertical direction, and the tips of the respective teeth slightly project from the front surface of the guide plate 43 so that the one recording medium is separated when the plurality of the recording media pushed out by the feeding unit 16 come into abutment with the tips of the teeth. A pair of rotatable feeding auxiliary rollers 45 are provided on the central protruded end at the upper end on widthwise both sides of the separating member 44.

The right side end guide 20R is provided with a cam portion 60 (swinging unit) for swinging a feeding roller 52 and an arm member 53 when pulling or inserting the feeding tray 9 from/into the apparatus body 3. The cam portion 60 is provided at the rear upper end of the guide wall 22 of the side end guide 20R so as to vary the height from the bottom surface of the bottom plate 18 along the front and rear direction, and, as shown in FIGS. 6A to 6E, includes an inclined surface 60A inclining downward toward the rear and an inclined surface 60B inclined upward toward the rear, and a horizontal portion 60C having the substantially constant height from the bottom surface of the bottom plate 18 continued from the front toward the rear. The horizontal portion 60C is formed to almost the rear end of the guide wall 22, and has substantially the same height as the upper end of the guide plate 43.

Figure 5:
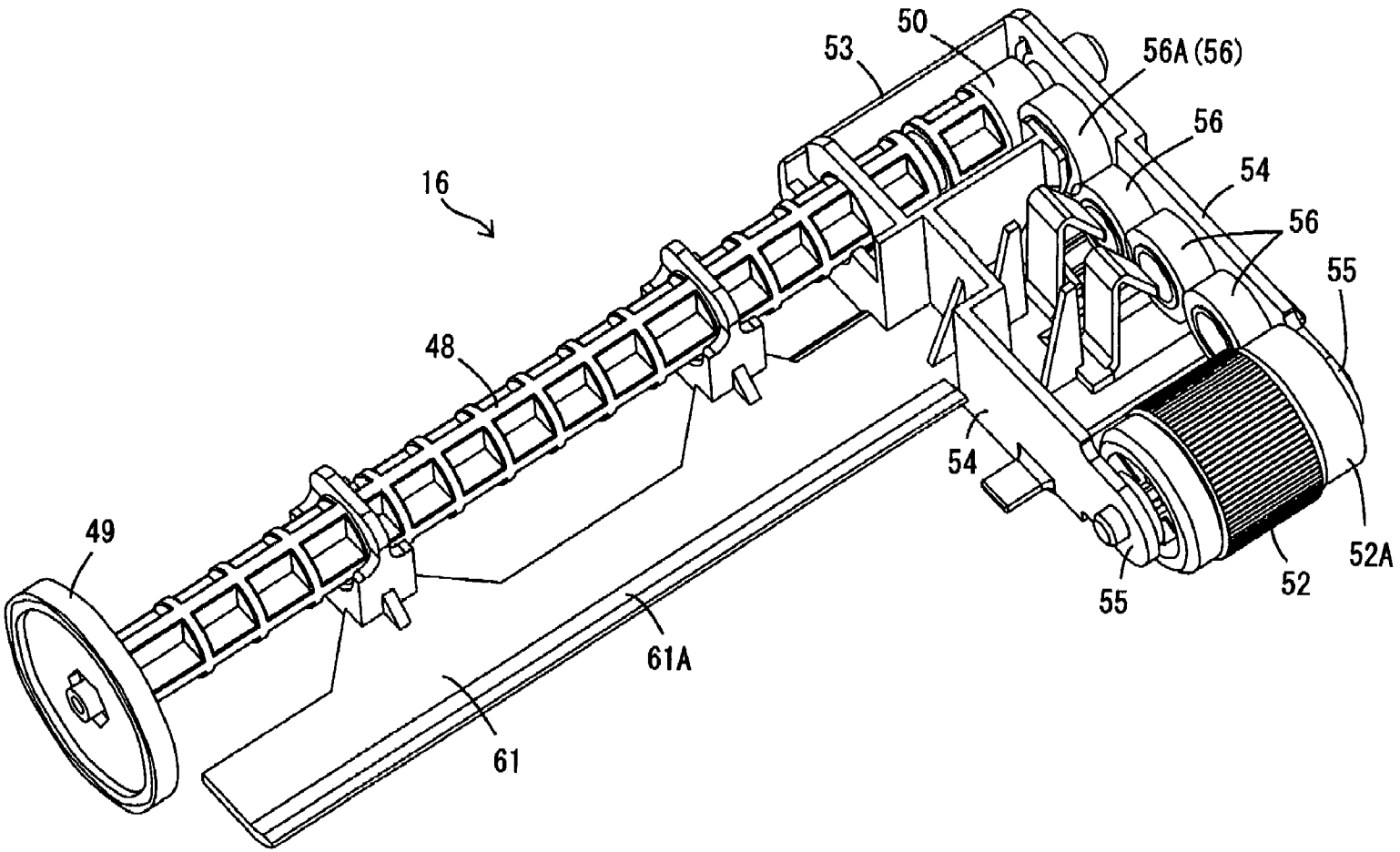
FIG. 5 is a perspective view of the feeding unit.
Figure 6A:
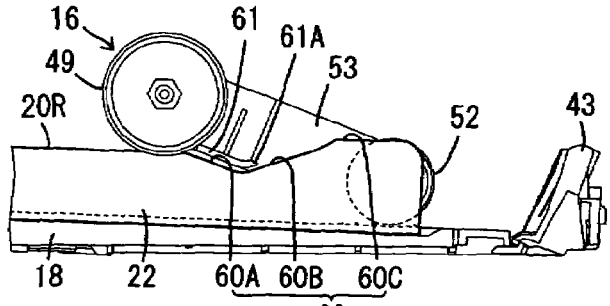
FIGS. 6A to 6E are side views showing the action of the feeding tray and the feeding unit.
Figure 6B:
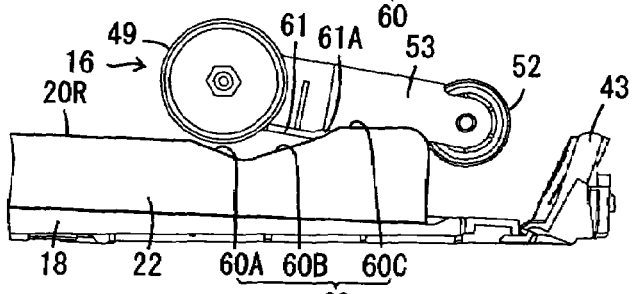
Figure 6C:
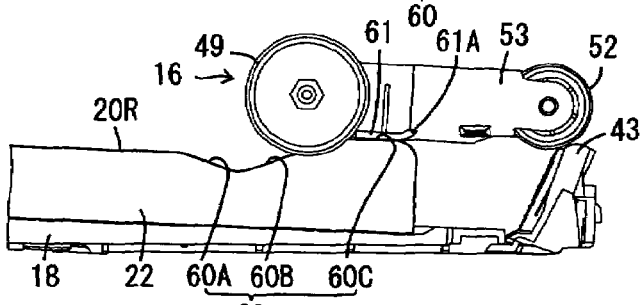
Figure 6D:
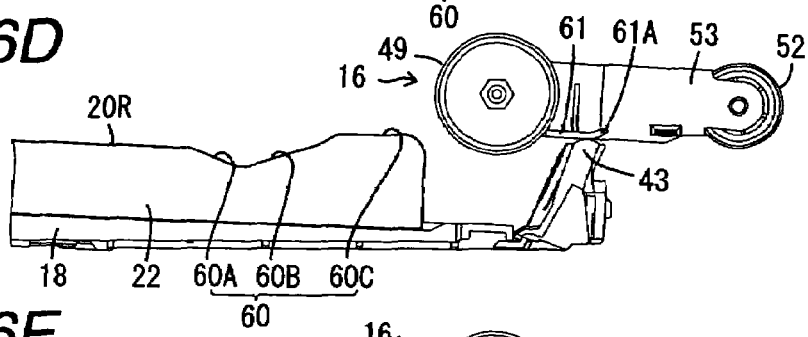
Figure 6E:
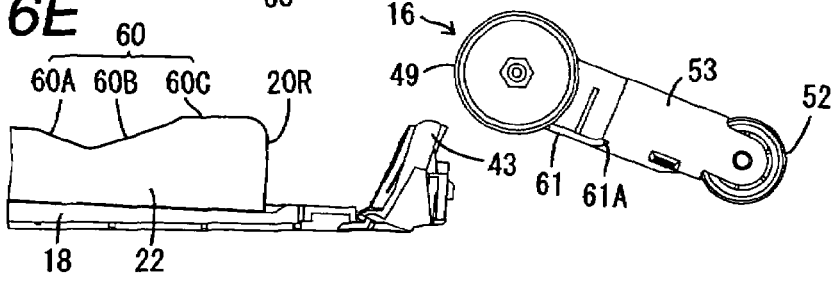

Subsequently, referring now to FIG. 2 and FIG. 5, the feeding unit 16 of the recording medium will be described. FIG. 5 is a perspective view of the feeding unit 16.

The apparatus body 3 is provided with a laterally elongated box-shaped frame 47 at the rear upper position of the feeding tray 9, and a rotatable support shaft 48 extends laterally (in the direction orthogonal to the recording medium feeding direction) is provided in the frame 47, and the feeding unit 16 is supported by the support shaft 48 as a whole. The support shaft 48 is arranged in the range from about the widthwise center of the feeding tray 9 to the right end. The support shaft 48 is provided with a large gear 49 at the widthwise outer end of the feeding tray 9, more specifically, at the end position slightly outer than the side end of the bottom plate 18. The large gear 49 is connected to the drive unit, not shown, so that the support shaft 48 is rotated by the power of the drive unit. The support shaft 48 is provided with a small gear 50 having substantially the same diameter at the other end thereof.

An arm member 53 for supporting a feeding roller 52 is mounted to the end of the support shaft 48 located at the widthwise center of the end of the feeding tray. The arm member 53 extends radially outward from the support shaft 48, and is provided with a pair of supporting arm 54 disposed in parallel with each other at a distance apart from each other in the lateral direction. The feeding roller 52 is arranged so as to be interposed between the distal ends (swinging ends) of the supporting arms 54, and the rotary shaft of the feeding roller 52 is supported by a bearing portions 55 provided on the supporting arms 54, whereby the feeding roller 52 is rotatably retained about the laterally extending axis. Between the supporting arms 54, there are provided four power transmitting gears 56 (power transmitting mechanism) for connecting the small gear 50 of the support shaft 48 and the gear portion 52A of the feeding roller 52 incorporated so as to be continued in the extending direction of the supporting arms 54, so that when the support shaft 48 is rotated by the drive unit, the rotational force is transmitted to the feeding roller 52 via the four power transmitting gears 56. A power transmitting gear 56A out of the four power transmitting gears 56 which directly engages the small gear 50 is so called a one-way gear for transmitting the rotational force from the support shaft 48 to the feeding roller 52, and for preventing the rotational force from the feeding roller 52 from being transmitted to the support shaft 48.

The arm member 53 can be swinged from the position inclined downward toward the rear, in which the rotary shaft of the feeding roller 52 is located at the position lower than the support shaft 48 to the horizontal position in which the rotary shaft of the feeding roller 52 is at almost the same level as the center of the support shaft 48. When the arm member 53 is in the horizontal position, the major part of the arm member 53 and the feeding roller 52 are stored in the frame 47. When the feeding tray 9 accommodated with the plurality of the recording media stacked thereon is mounted to a normal mounting position of the tray storage 10, the swingal end of the arm member 53 is moved downward by its own weight, and the feeding roller 52 is placed on the uppermost layer of the recording medium on the uppermost layer. By pushing the recording medium rearward and the leading edge of the recording medium is pressed against the aforementioned guide plate 43 by rotating the feeding roller 52 counterclockwise in FIG. 2, one of the recording medium is separated and delivered to the free passage 15. A corkplate 57 having a large coefficient of friction with respect to the recording medium is adhered on the rear stacking surface 19A of the feeding tray 9 at the position which can abut against the feeding roller 52 in a state in which the recording media is not placed thereon, whereby the last one of the recording medium to be stacked on the feeding tray 9 can easily be delivered by the feeding roller 52.

The feeding unit 16 is provided with a driven portion 61 which swings the feeding roller 52 and the arm member 53 in cooperation with the cam portion 60 and the guide plate 43 when pulling out or inserting the feeding tray 9 from/into the apparatus body 3. The driven portion 61 is integrally provided so as to extend from the lower end of the supporting arm 54 of the arm member 53 located on the support shaft 48 side along the support shaft 48, and has a plate shape which is aligned substantially in flush with the lower end surface of the supporting arm 54 as a whole. Since the arm member 53 and the end of the driven portion 61 on the other side extend substantially to the position corresponding to the side end of the feeding tray 9 in a state in which the feeding tray 9 is mounted to the normal mounting position, the driven portion 61 is located above the guide wall 22 irrespective of the lateral position of the side end guide 20R. The rear edge 61A of the driven portion 61 is bent slightly upward, and the distance from the center of the support shaft 48 to the rear edge 61A is slightly less than half the distance from the center of the support shaft 48 to the rotary shaft of the feeding roller 52. As will be described later, the driven portion 61 is adapted to be shifted in the vertical direction when the lower surface of the feeding tray 9 comes into sliding contact with the cam portion 60 or the guide plate 43 upon pulling out or inserting in, so that the arm member 53 swings.

Figure 7:
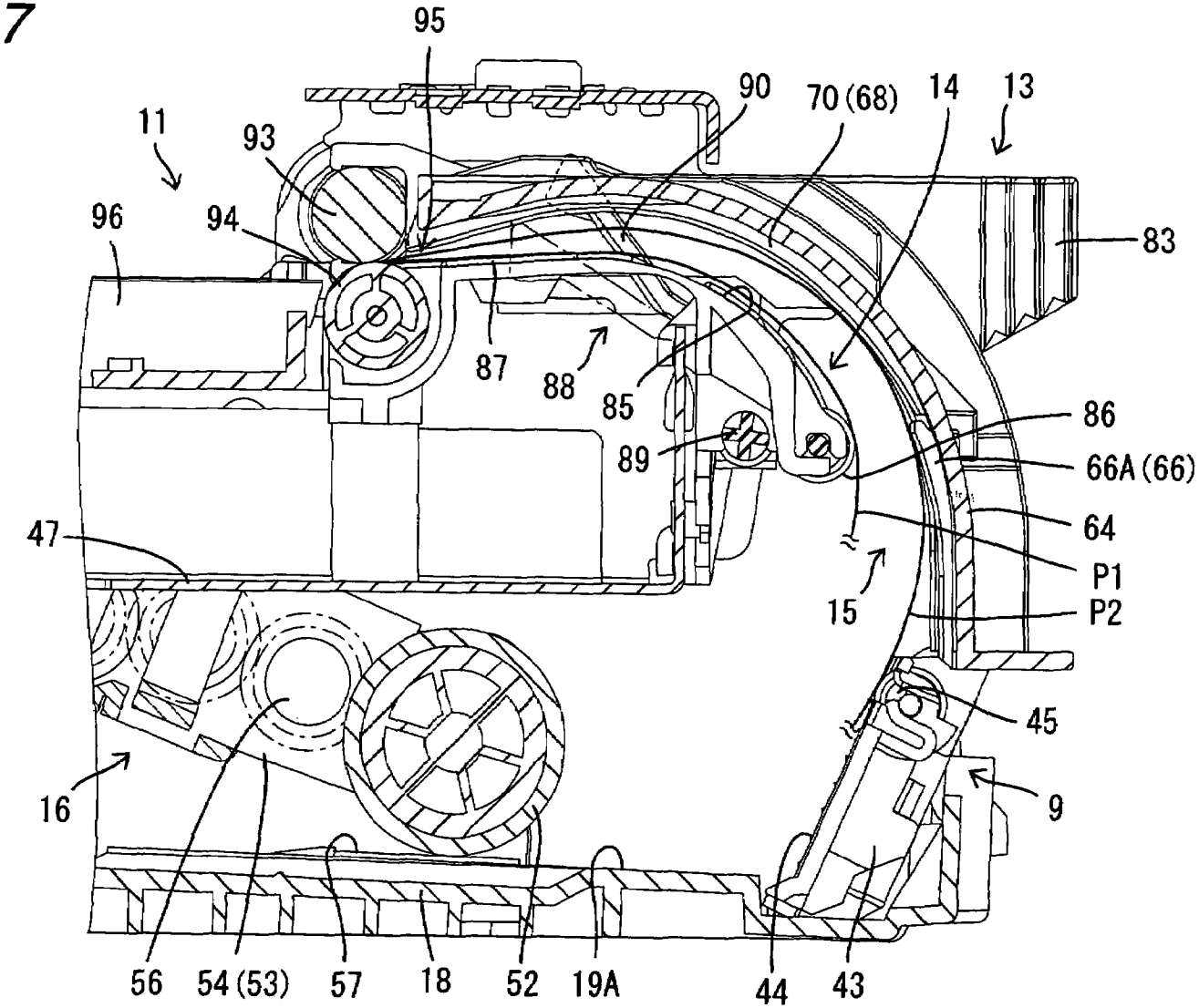
FIG. 7 is a cross-sectional view partly enlarged of the image recording apparatus.
Figure 8:
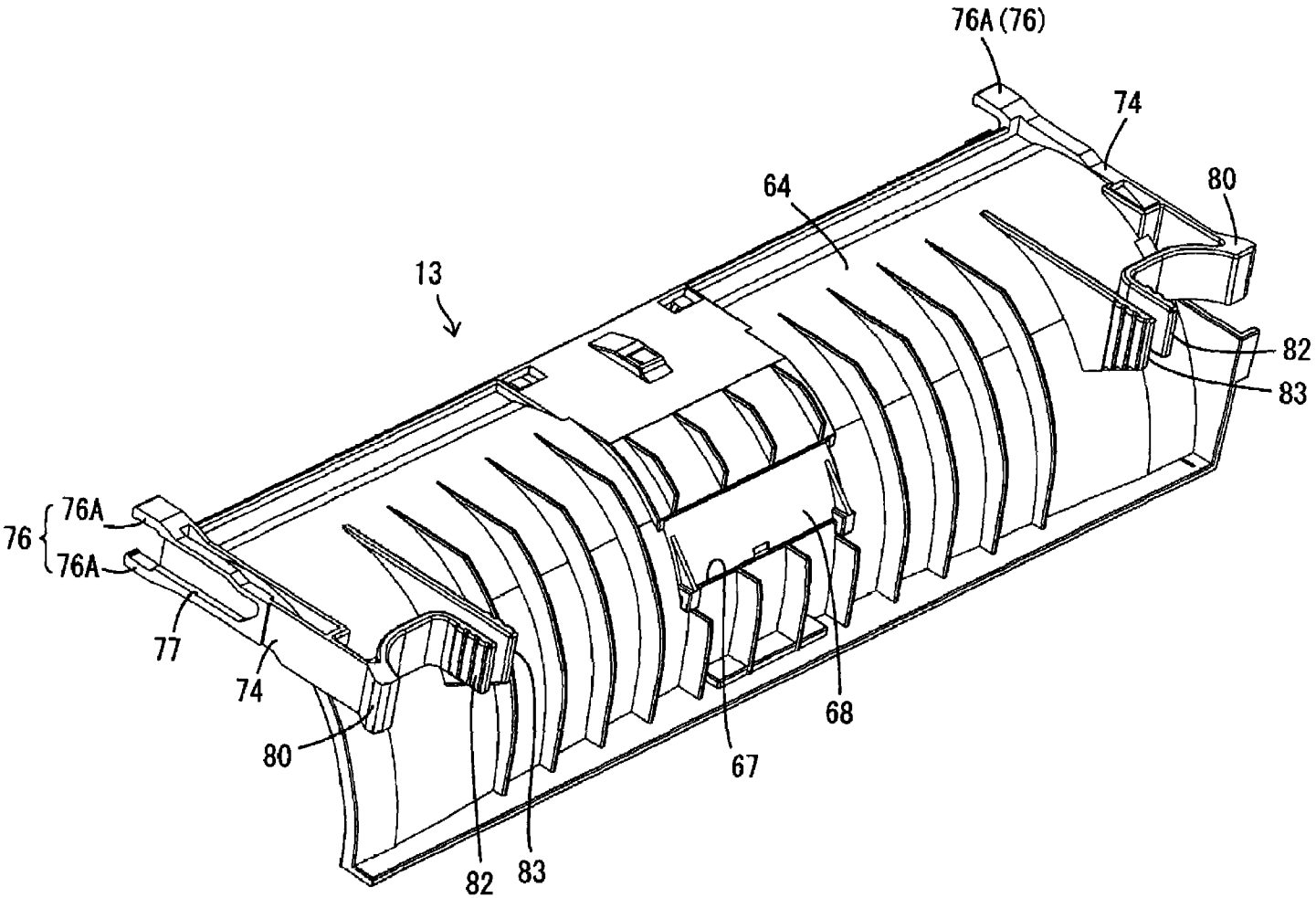
FIG. 8 is a perspective view of a rear surface of an outer arcuate guide.
Figure 9:
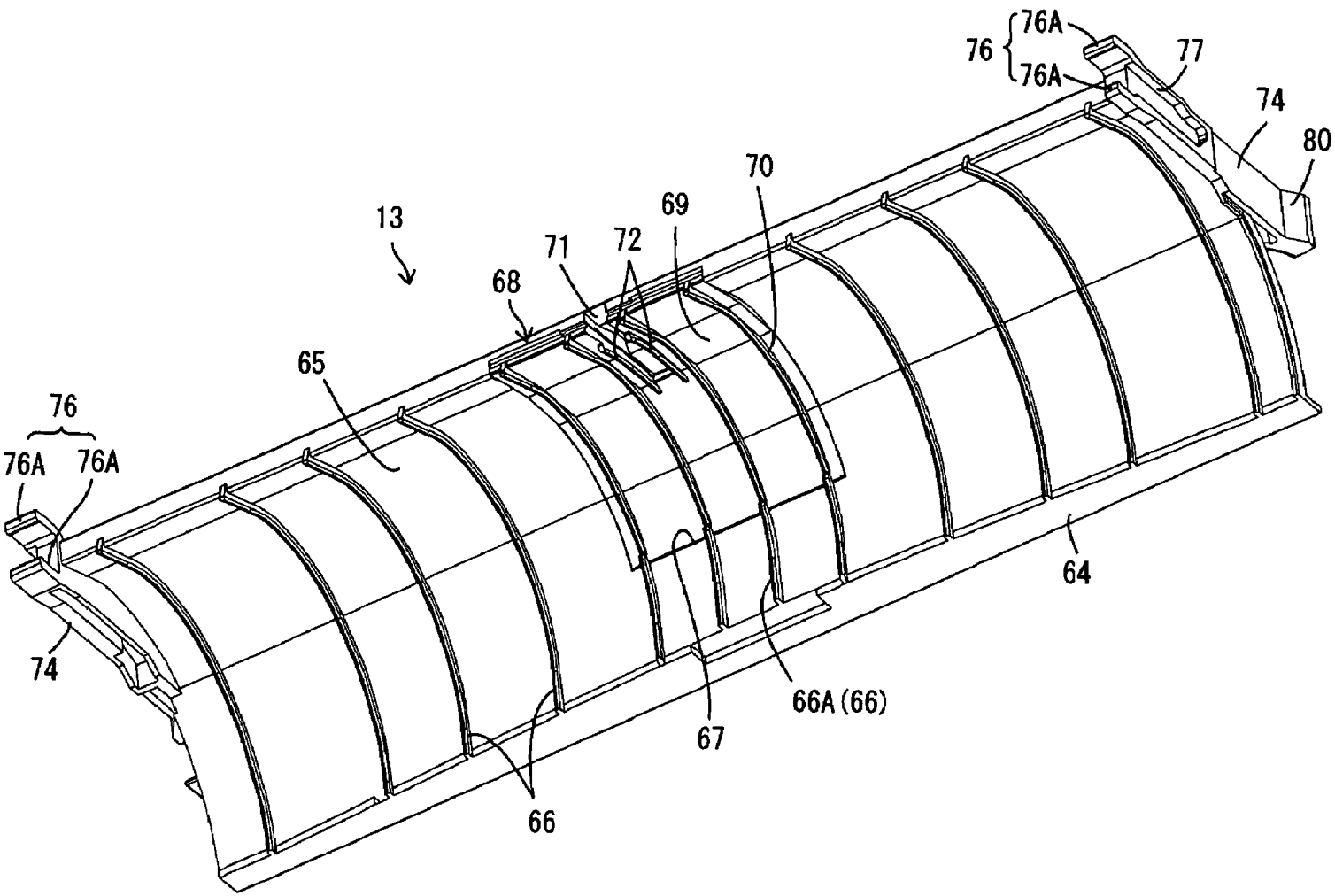
FIG. 9 is a front perspective view of the outer arcuate guide.
Figure 10:
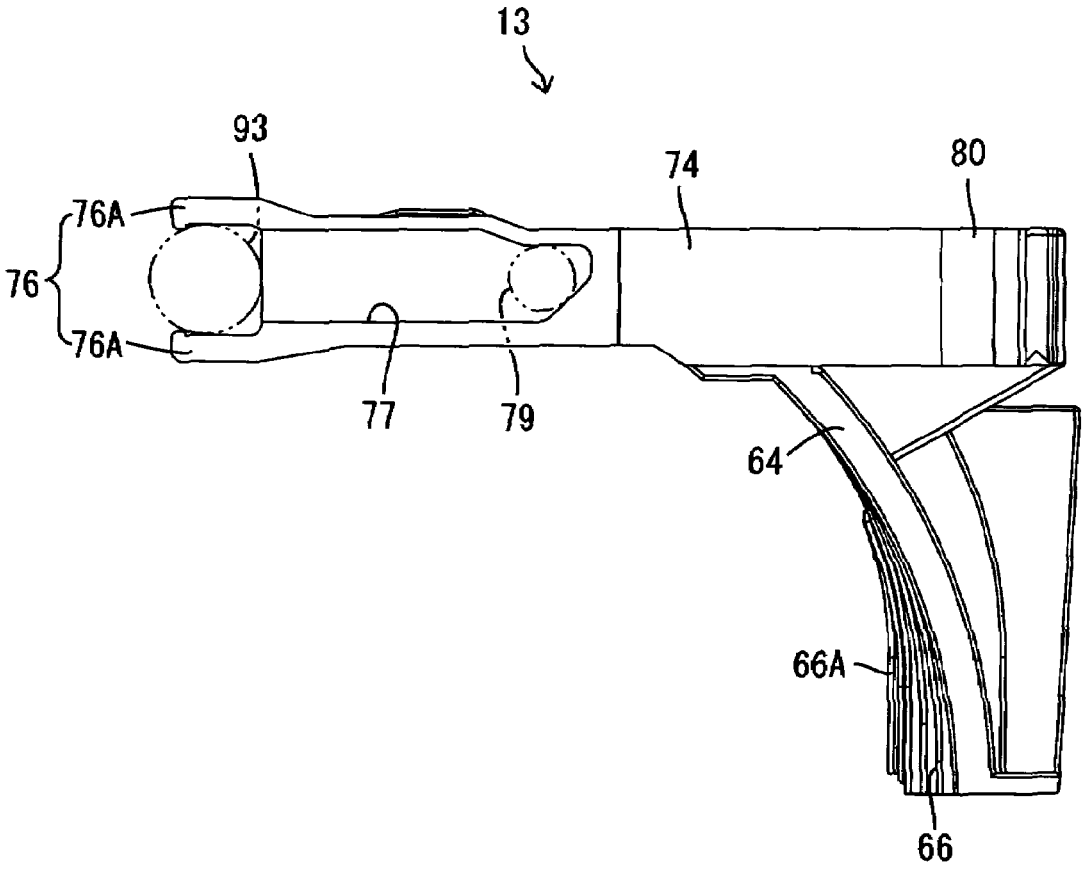
FIG. 10 is a side surface view of the outer arcuate guide.
Figure 11:
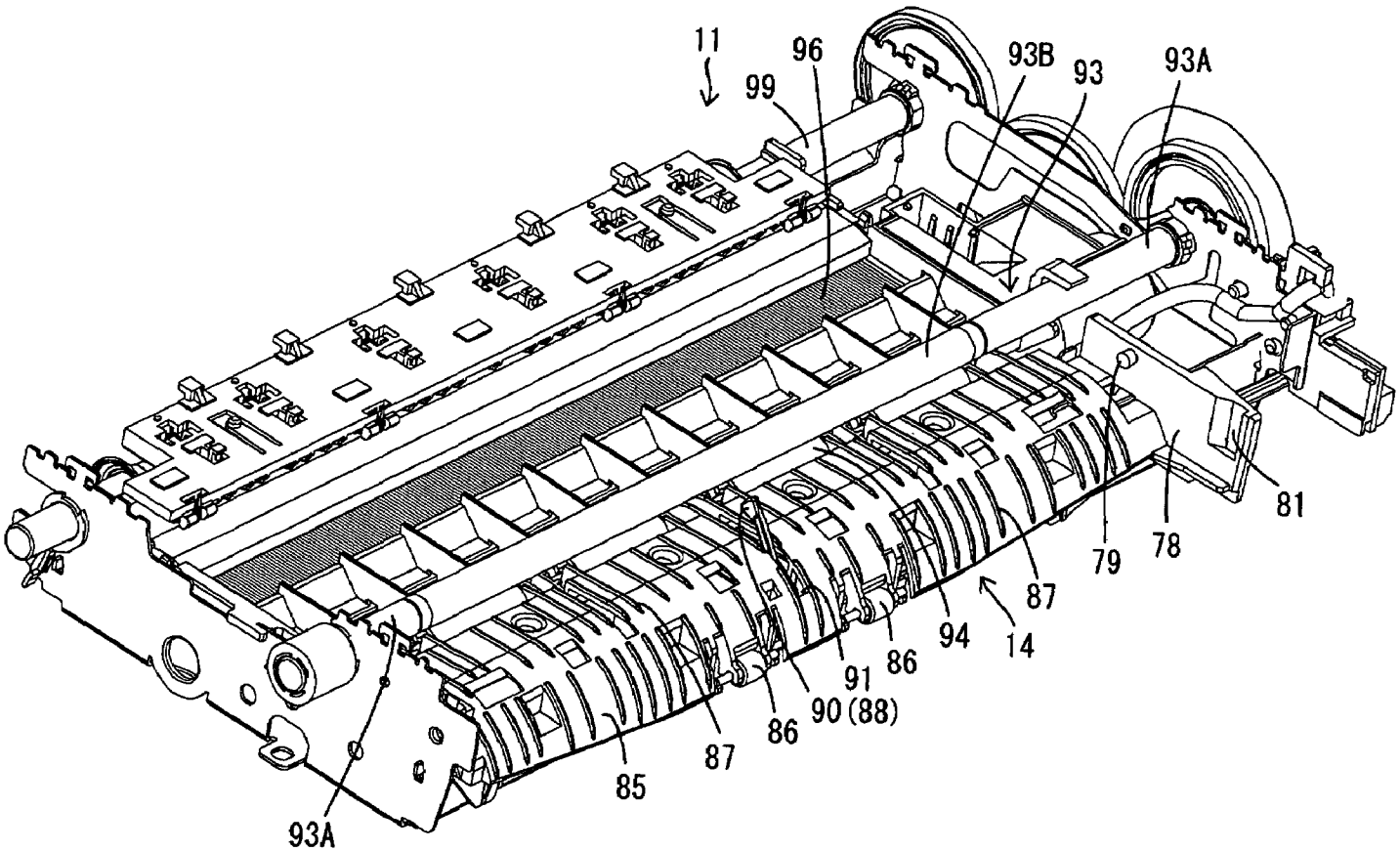
FIG. 11 is a perspective view showing a part of the image recording apparatus in a state in which the outer arcuate guide is removed.
Figure 12:
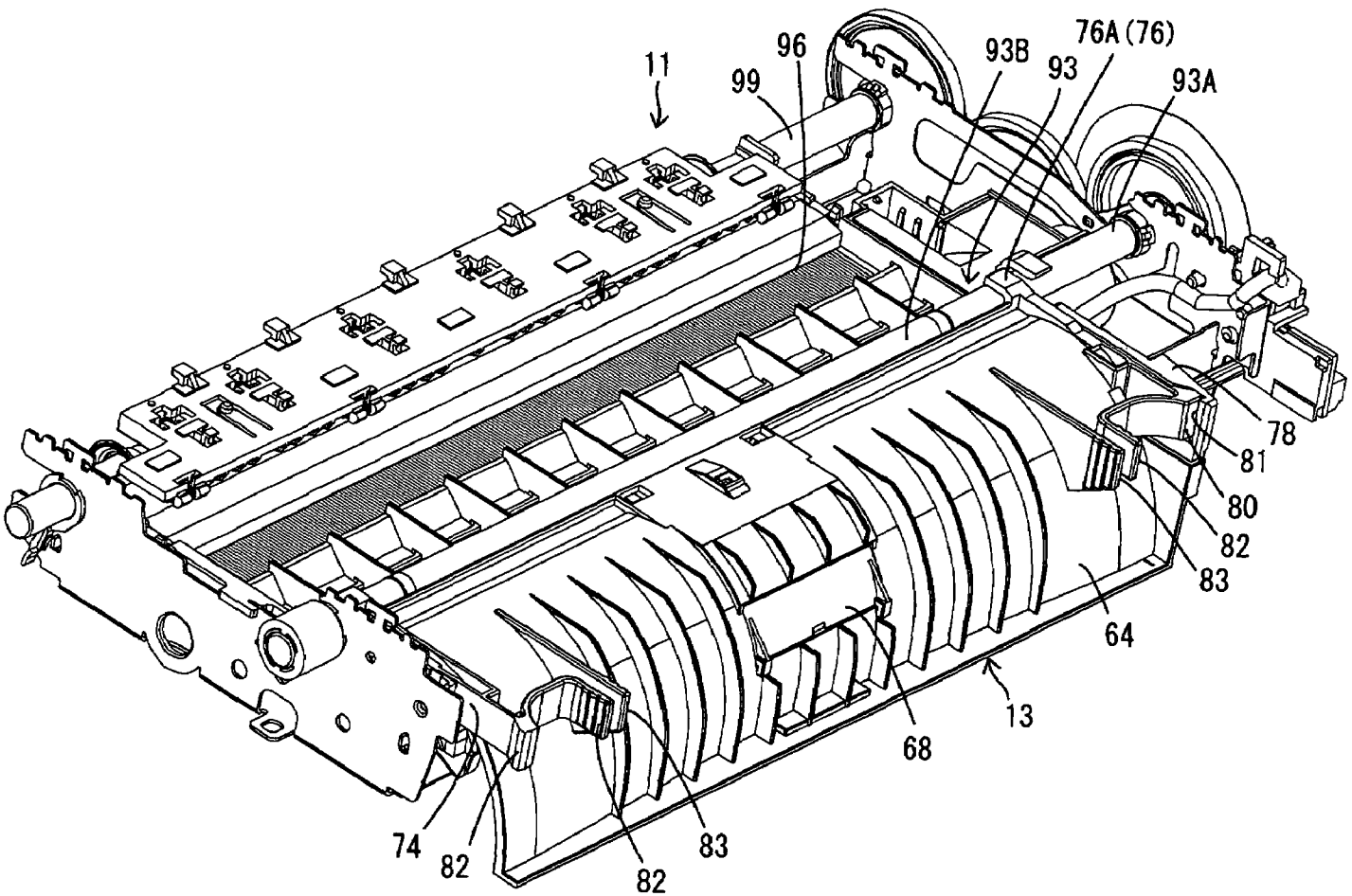
FIG. 12 is a perspective view showing a part of the image recording apparatus in a state in which the outer arcuate guide is mounted.

Subsequently, referring to FIG. 7 to FIG. 12, the outer arcuate guide 13 will be described. FIG. 7 is a partly enlarged cross-sectional view of the image recording apparatus 1; FIG. 8 is a perspective view of the outer arcuate guide 13 when viewed obliquely from upper rear direction; FIG. 9 is a perspective view of the outer arcuate guide 13 when viewed obliquely from lower front direction; FIG. 10 is a side view of the outer arcuate guide 13; FIG. 11 is a perspective view showing part of the image recording apparatus 1 in a state in which the outer arcuate guide 13 is removed; FIG. 12 is a perspective view showing a part of the image recording apparatus 1 in a state in which the outer arcuate guide 13 is mounted.

The outer arcuate guide 13 is mounted to a position rearwardly of the image recording unit 11 and upwardly of the rear end of the feeding tray 9, and is capable of attaching and detaching through a guide mounting hole 63 opened on the rear surface of the casing 2 (see FIG. 2 as well). The entire outer arcuate guide 13 is stored in the casing 2, and the rear end of the outer arcuate guide 13 substantially matches the rear surface of the casing 2. The outer arcuate guide 13 is provided with a main body 64 elongated in the direction of width and curved substantially in the arcuate shape, and the main body 64 is formed with an outer guiding surface 65 for guiding the recording medium so as to oppose to the free passage 15. The outer guiding surface 65 is formed in the range substantially the same as the feeding tray 9 in the lateral direction. The upstream end of the outer guiding surface 65 is located at the upper end of the guide plate 43, and the downstream end of the outer guiding surface 65 is located immediately in front of a registration roller 93 and a driven roller 94 constituting a recording medium insertion port 95 of the image recording unit 11, described later. The outer guiding surface 65 has a substantially arcuate shape extending substantially perpendicularly near the upstream end, and inclining gradually forwardly as it goes toward the downstream side, and then after having become horizontal, inclining downwardly toward the front to reach the downstream end. The portion of the outer guiding surface 65 in the vicinity of the downstream end is flat surface. The outer guiding surface 65 is formed with a plurality of projecting ribs 66 extending along the direction of transportation of the recording medium at predetermined intervals arranged in the widthwise direction. Also, the portion of the outer guiding surface 65 near the down stream end projects toward the free passage 15 at the widthwise center portion, whereby the projecting dimension of the rib 66A located at the widthwise center toward the free passage 15 is larger than the ribs 66 at other positions.

The main body 64 is formed with a mounting recess 67 at the widthwise center of the outer guiding surface 65 on the downstream side of the projecting portion, and a curved plate shaped resistance reducing portion 68 is attached to the mounting recess 67. The outer arcuate guide 13 including the main body 64 and the resistance reducing portion 68 is entirely formed of synthetic resin, and the resistance reducing portion 68 is formed of synthetic resin which has smaller frictional resistance with respect to the recording medium than the synthetic resin constituting other portions. More specifically, the resistance reducing portion 68 is formed of polyacetal resin (POM) or the like, and other portions are formed, for example, of polystyrene resin (PS) or the like. The surface of the resistance reducing portion 68 is formed with a guiding surface 69 having a shape substantially like the outer guiding surface 65 of the main body 64, and the guiding surface 69 is formed with a plurality of projecting ribs 70 extending along the recording medium transporting direction continuously from the ribs 66A formed on the aforementioned projected portion of the main body 64. The projecting dimension of the ribs 70 on the resistance reducing portion 68 near the upstream end is slightly smaller than the projecting dimension at the upper end of the rib 66A on the side of the main body 64. Accordingly, such a situation that the leading edge of the recording medium gets held by the ribs 70 on the side of the resistance reducing portion 68 may be prevented since the lower ends of the ribs 70 on the resistance reducing portion 68 projects more than the ribs 66A on the side of the main body 64 due to the formation error or the like. Also, the guiding surface 69 of the resistance reducing portion 68 is formed with a detection strip receiving hole 71 which can receive the tip of a detection strip 90 of the registration sensor 88, described later, at the widthwise center near the downstream end. The detection strip receiving hole 71 is provided with a detection auxiliary ribs 72 which are elongated along the recording medium transporting direction and having the same projecting dimension with other ribs 70 at the edges on the widthwise both sides of the opening.

Side plate portions 74 extending in the front and rear direction are formed at the upper end of both ends of the main body 64. The front end positions of the side plate portions 74 substantially match the positions of the downstream end of the outer guide surface 65, and registration engagement devices 76 having an upper and lower pair of engaging claws 76A projecting toward the front are provided at the front ends of the side plate portions 74. Journaled portions 93A of the registration roller 93 can be fitted between the pair of engaging claws 76A of the registration engagement device 76.

The respective side wall portions 74 are formed on the outside surfaces thereof with guide grooves 77 extending from between the engaging claws 76A of the registration engagement portions 76. On the other hand, the apparatus body 3 is provided with a pair of side walls 78 at both ends of the outer arcuate guide 13 (see FIG. 11, in the same drawing, the side wall 78 on the near side is not shown, it has substantially symmetrical shape with the one on the far side), and the respective side walls 78 are provided with guide projections 79 which are capable of engaging with the guide grooves 77. The guide projections 79 and the guide grooves 77 have a function to guide the outer arcuate guide 13 to the adequate mounting position when mounting the outer arcuate guide 13 to the apparatus body 3. The width of the guide grooves 77 other than the end portions is slightly larger than the outer diameter of the guide projections 79, and the width of the grooves is reduced so that the guide projections 79 can fit tightly.

The respective side plate portions 74 are provided with locking portions 80 so as to project from the rear ends thereof. The locking portions 80 can be flexibly deformed in the lateral direction, and the distal ends thereof project outward, so that the outer arcuate guide 13 is locked to the adequate mounting position by engaging the distal ends to recessed engaged portions 81 formed on the respective side walls 78. Releasing members 82 bent in an angular C-shape extend inwardly in the widthwise direction of the outer arcuate guide 13 from the distal ends of the respective locking portions 80, so that the releasing members can shift the locking portions 80 in the direction of releasing engagement with respect to the engaged portions 81. The main body 64 is formed on the rear surface thereof with a pair of left and right plate-shaped gripping portions 83 so as to extend rearward, and the gripping portions 83 are arranged so that the distal ends of thereof oppose to the distal end of the releasing members 82 at a predetermined distance apart from each other. By pinching the gripping portions 83 simultaneously with the releasing members 82, the outer arcuate guide 13 can be attached and detached.

The inner arcuate guide 14 is arranged in the apparatus body 3 at a distance with respect to the outer arcuate guide 13, and the surface opposing to the outer arcuate guide 13 corresponds to an inner guiding surface 85. The upstream side (rear side) of the inner guiding surface 85 is formed into a projecting arcuate surface having a larger curvature than the outer guiding surface 65 of the outer arcuate guide 13, and the downstream side (front side) is substantially horizontal flat plane. The upstream side end (lower end) of the inner guiding surface 85 is located upwardly of the upstream side end of the outer guiding surface 65, and a pair of left and right feeding auxiliary rollers 86 are rotatably provided at the widthwise center thereof. The inner guiding surface 85 is provided with a plurality of projecting ribs 87 extending along the recording medium transporting direction separately on the front side and the rear side, and arranged in the widthwise direction at predetermined intervals.

The U-shaped free passage 15 is formed between the inner guiding surface 85 of the inner arcuate guide 14 and the outer guiding surface 65 of the outer arcuate guide 13, as described above. The distance between the guiding surfaces 65, 85 of the arcuate guides 13, 14 are larger on the upstream side (entrance side of the free passage 15), and decreases gradually toward the downstream. Then, the distance between the guiding surfaces 65, 85 is set to a value sufficiently larger than the thickness of the recording media except for the portion near the downstream end, so as to allow the recording medium to shift in the direction of the thickness in the free passage 15. In the area near the downstream end, the distance between the guide surfaces 65, 85, in a narrow sense, the distance between the positions of the distal ends of the ribs 66, 87 on the both guiding surfaces 65, 85 are set to a relatively small value, so that the leading edge of the recording medium coming out from the free passage 15 is accurately registered with respect to the recording medium insertion port 95 configured by the registration roller 93 and the driven roller 94. In this manner, when the recording medium is being transported from the feeding roller 52 to the registration roller 93, means for transporting the recording medium tightly as a pinch roller is not provided.

The registration sensor 88 for detecting the leading edge and the trailing edge of the recording medium is provided at the widthwise center on the lower side (on the side of the opposite surface from the inner guiding surface 85) of the inner arcuate guide 14. The registration sensor 88 is provided with a detection strip 90 which can rotate about a mounting shaft 89 extending in the lateral direction, and the detection strip 90 is urged in the clockwise direction in FIG. 7 by a spring member (not shown). A through-hole 91 is formed at the widthwise center of the upper surface of the inner arcuate guide 14, and the distal end of the detection strip 90 projects into the free passage 15. When the distal end of the detection strip 90 does not interfere with the recording medium in the free passage 15, it is received in the detection strip receiving hole 71 on the outer arcuate guide 13 (hereinafter, referred to as a non-interfered position, see a solid line in FIG. 7). When the distal end of the detection strip 90 interferes with the recording medium, the detection strip 90 retracts downward (referred to as interfered position, see a two double-dashed line in FIG. 7). The registration sensor 88 is provided with a photo interrupter (not shown) for detecting the position of the detection sensor 90.

Referring now to FIG. 2, FIG. 7, and FIG. 11, the image recording unit 11 will be described. The registration roller 93 is provided at the upstream end (rear end) of the image recording unit 11 so as to extend in the lateral direction. Journaled portions 93A secured to the apparatus body 3 are provided at both ends of the registration roller 93, and rotating portions 93B which are rotatable by a power from the drive unit are provided between the both journaled portions 93A. A plurality of driven rollers 94 which are rotatable with the registration roller 93 are provided below the rotating portions 93B of the registration roller 93. Formed between the registration roller 93 and the driven rollers 94 is the recording medium insertion port 95, and the downstream end of the aforementioned free passage 15 is connected to the recording medium insertion port 95.

The image recording unit 11 is provided with a platen 96 on the downstream side (front side) of the driven rollers 94 for supporting the recording medium from below. A carriage 98 having a recording head 97 mounted thereon is provided above the image recording unit 11, and the carriage 98 moves above the platen 96 in the lateral direction and the recording head 97 discharges ink on the recording medium on the platen 96 for recording the image. Provided on the downstream side of the platen 96 is a discharge roller 99 extending in the lateral direction. The discharge roller 99 discharges the recording medium on which an image is recorded by the recording head 97 onto the feeding tray 9 by being rotated in conjunction with the registration roller 93.

The structure of the embodiment has been described thus far, and the operation thereof will be described below.

When allowing the recording medium to be stacked on the feeding tray 9 stored in the apparatus body 3, the feeding tray 9 is pulled out toward the front from the tray storage 10. At this time, by hooking fingers into the finger hole 40 of the auxiliary supporting member 39 stored in the supporting member storage hole 38 and into the second finger hole 41 on the bottom plate 18 for pulling toward the operator, the feeding tray 9 can easily be pulled out.

When pulling out the feeding tray 9 in a state in which the recording media are stacked in advance, it is necessary to pull out the recording medium from the lower side of the feeding roller 52 which is placed on the upper surface thereon. Assuming that the rear stacking surface 19A of the feeding tray 9 is a horizontal plane, the recording medium may be caught by the feeding roller 52 when pulling out the feeding tray 9. In contrast, according to this embodiment, since the rear stacking surface 19A of the feeding tray 9 is inclined downwardly toward the downstream side (rear side) in the recording medium feeding direction, when the feeding tray 9 is pulled out, the recording medium is moved downwardly apart from the feeding roller 52, and hence the recording medium is hardly be caught by the feeding roller 52, whereby the feeding tray 9 can be pulled out smoothly.

Subsequently, the operation of the feeding unit 16 when pulling out the feeding tray 9 will be described. When the feeding tray 9 is at the adequate mounting position, the feeding roller 52 is in the state of being abutted against the upper surface of the recording medium or the rear stacking surface 19A of the bottom plate 18, and the driven portion 61 is at the position apart upwardly from the inclined surface 60A of the cam portion 60 (see FIG. 6A). When the feeding tray 9 is pulled toward the front from this state, the rear edge 61A of the driven portion 61 comes into abutment with the inclined surface 60B of the cam portion 60, moves upward in sliding contact with the inclined surface 60B, and accordingly, the arm member 53 swings counterclockwise of the same drawing, whereby the feeding roller 52 is lifted (see FIG. 6B). When the feeding tray 9 is pulled further forward, the rear edge 61A of the driven portion 61 moves over the inclined surface 60B of the cam portion 60, and then the driven portion 61 climbs over the upper surface of the horizontal portion 60C, whereby the arm member 53 is brought into the substantially horizontal posture (See FIG. 6C). Then, the feeding roller 52 comes into abutment with the upper end of the guide plate 43, and moves over the guide plate 43 while rotating by the friction with respect to the guide plate 43. When the feeding roller 52 passes beyond the guide plate 43, the upper end of the guide plate 43 comes into abutment with the lower surface of the arm member 53, and moves toward the support shaft 48 in sliding contact with the arm member 53 (see FIG. 6D). Then, when the upper end of the guide plate 43 gets out from the lower surface of the arm member 53 toward the front, the feeding roller 52 moves downward by its own weight (see FIG. 6E).

In this manner, since the cam portion 60 for lifting the feeding roller 52 when attaching and detaching the feeding tray 9 is provided on the side end guide 20R, the side wall of the feeding tray 9 can be omitted, whereby the width of the feeding tray 9 can be reduced and hence downsizing of the apparatus is achieved.

Also, since the feeding tray 9 is provided not only with the shiftable side end guides 20R, 20L, but also the fixed side walls 32 in front thereof, it can be held by hand easily. The fixed side walls 32 are aligned substantially in flush with the side end guide 20R, and hence the width of the feeding tray 9 is not increased.

When the feeding tray 9 is removed from the apparatus body 3 in this manner the recording media to be used are placed in stack on the stacking surfaces 19A, 19B. When using the recording media such as A4 size or B5 size, the recording media are inserted from the front of the feeding tray 9 through the lower side of the cover member 33 to the position where they abut against the inner guide plate 43. At this time, since the cover member 33 is formed with a notch 36, even the recording media smaller than A4 size (B5 size, for example) can be inserted easily to the innermost position. When using the recording media of, for example, postcard size or large-photo size, which is smaller than B5 size, the corresponding registration rib 31 is stood upright and the recording media are placed between the registration rib 31 and the guide plate 43.

Subsequently, when the both side ends of the recording media are not aligned with the respective guide walls 22, the positions of the both side end guides 20R, 20L are adjusted in the lateral direction, so as to match the guide walls 22 to the both side ends of the recording media. At this time, when the right side end guide 20R is shifted in the widthwise direction, the left side end guide 20L is also moved therewith, and hence good registering workability is achieved. When the both side walls 22 are aligned with the both side end positions of the recording media, the recording media is registered at widthwise center of the feeding tray 9.

Subsequently, the feeding tray 9 accommodating the recording media stacked thereon is stored in the apparatus body 3. When the feeding tray 9 is inserted into the tray storage 10 from the front horizontally, the upper end of the guide plate 43 first comes into abutment with the driven portion 61 and the arm member 53, and the driven portion 61 and the arm member 53 climb over the guide plate 43. Then, the feeding roller 52 is lifted, and the arm member 53 swings to the substantially horizontal posture (See FIG. 6D). When the feeding tray 9 is inserted further inwardly from this state, the driven portion 61 climbs over the horizontal portion 60C of the cam portion 60, and subsequently, the feeding roller 52 comes into abutment with the upper end of the guide plate 43 and climbs over the same (see FIG. 6C). Then, the rear edge 61A of the driven portion 61 moves along the inclined surface 60B of the cam portion 60 and the feeding roller 52 moves downward (see FIG. 6B). Accordingly, the feeding roller 52 comes into abutment with the upper surface of the recording media stacked on the stacking surfaces 19A, 19B, and the driven portion 61 is lifted upward from the cam portion 60. At this time, since the rear stacking surface 19A of the feeding tray 9 for the recording media is inclined downward toward the downstream side in the recording medium feeding direction (rear end side), the recording medium is inserted below the feeding roller 52 so as to push the feeding roller 52 upward from below. Therefore, in comparison with the case in which the stacking surface of the recording medium is horizontal, the recording medium can hardly be caught by the feeding roller 52, whereby displacement of the recording medium can be prevented. When the feeding tray 9 is inserted to the adequate mounting position (the position shown in FIG. 6A), mounting of the feeding tray 9 is completed.

Subsequently, the operation when recording an image on the recording media will be described. Firstly, the large gear 49 is rotated by a power from the drive unit, and the rotation is transmitted to the feeding roller 52 via the power transmitting gear 56. Accordingly, when the feeding roller 52 rotates counterclockwise in FIG. 7, the recording media on the stacking surface 19A, 19B are pushed rearward and pushed against the guide plate 43. Since the center portion of the guide plate 43 is protruded toward the front, the leading edge of the recording medium pushed against the guide plate 43 is guided upward while taking a bent posture with the center portion been slightly higher. Then, when the center portions of the distal ends of the recording media come into abutment with the teeth of the separating member 4 provided at the protruding end of the guide plate 43, the uppermost sheet is separated. In this manner, it is delivered to the free passage 15 located above while keeping in abutment with the feeding auxiliary rollers 45 provided at widthwise both sides of the separating member 44 at the upper end of the guide plate 43.

The leading edge of the recording medium delivered upward from the guide plate 43 comes into abutment with the portion near the upstream side end portions of the outer guiding surface 65 of the outer arcuate guide 13. Here, in the vicinity of the upstream side end portion of the outer arcuate guide 13, the overhanging dimension of the rib 66A at the widthwise center out of the plurality of ribs 66 toward the free passage 15 is set to be larger than other ribs, and hence the widthwise center portion of the leading edge of the recording medium which takes the bent posture by the guide plate 43 come into abutment with the rib 66A, and the widthwise both ends are released rearward. Therefore, by the abutment between the leading edge of the recording medium and the outer arcuate guide 13, the widthwise center of the recording medium is prevented from lifting upward from the guide plate 43, and hence the contact between the recording medium and the feeding auxiliary roller 45 can be maintained.

In this manner, the leading edge of the recording medium delivered into the free passage 15 is mainly guided upward in sliding contact with the rib 66A at the center of the outer guiding surface 65. Subsequently, the center portion at the leading edge of the recording medium comes into abutment with the ribs 70 of the resistance reducing portion 68. The center portion of the leading edge of the recording medium is guided toward the downstream while keeping in sliding contact with the ribs 70 of the resistance reducing portion 68, and the widthwise both ends also come into sliding contact with the ribs 66 on the outer guiding surface 65, and the posture of the leading edge of the recording medium is gradually corrected to the straight posture, whereby the leading edge is guided toward the front.

In this manner, since there is provided the resistance reducing portion 68 having a small frictional resistance with respect to the recording medium at the widthwise center of the outer arcuate guide 13, the recording medium is prevented from being caught in the transportation path, thereby being guided downstream smoothly. When the entire outer arcuate guide is formed of resin which has low frictional resistance with respect to the recording medium, there may be a case in which the forming accuracy can hardly be achieved, or the cost is increased. However, according to this embodiment, by employing resin member having a low contact resistance at the center portion where the high contact pressure is exerted from the recording medium, the frictional resistance with respect to the recording medium is reduced and deterioration of the forming accuracy or increase in cost can be avoided.

When the leading edge of the recording medium comes into abutment with the detection strip 90 of the registration sensor 88 projected into the free passage 15, the detection strip 90 is pressed by the recording medium and pushed downward (interfered position, see two-double dashed line in FIG. 7), whereby the fact that the leading edge of the recording medium reaches the position of the detection strip 90 is detected. Here, since the projecting detection auxiliary rib 72 is provided at the edges of the opening on the both sides of the detection strip receiving hole 71, the recording medium pressed by the urging force of the detection strip 90 is supported by the pair of the detection auxiliary ribs 72 from the opposite side of the detection strip 90, and hence the recording medium is prevented from bending inwardly of the detection receiving hole 71. Accordingly, since the shifting amount of the detection strip 90 between the interfered position and the non-interfered position can be secured sufficiently, accuracy of detection of the recording medium can be increased.

The leading edge of the recording medium passed through the abutment position with respect to the detection strip 90 goes out from the free passage 15 and reaches the recording medium insertion port 95 between the registration roller 93 and the driven rollers 94. Here, since the portion of the outer guiding surface 65 near the downstream side of the outer arcuate guide 13 is flat surface, the leading edge of the recording medium is directed toward the recording medium insertion port 95 accurately.

The resist roller 93 is controlled to be rotated in the reverse direction (counterclockwise in FIG. 7) at the timing when the leading edge of the recording medium is detected by the registration sensor 88, and rotated in the normal direction (clockwise in FIG. 7) after a predetermined time period. Since the registration roller 93 is rotating in the reverse direction at the timing when the leading edge of the recording medium reaches the recording medium insertion port 95 between the both rollers 93, 94, it cannot be inserted between the both rollers 93, 94, and here, the inclination of the recording medium is corrected.

Then, when the registration roller 93 is rotated in the normal direction at a predetermined timing, the leading edge of the recording medium is caught between the both rollers 93, 94, and the recording medium is pulled toward the front. Here, in the case of the recording medium formed of material which is of relatively high flexibility (for example, a thin printing sheet, or OHP sheet), if the leading edge of the recording medium is pulled toward the front, the recording medium which has taken a posture extending along the ribs 66, 70 on the outer arcuate guide 13 is shifted toward the inner arcuate guide 14 and takes in turn a posture extending along the inner guide surface 85. Then the registration roller 93 is rotated from this state, a recording medium P1 is delivered to the downstream side by the feeding auxiliary roller 86, and is pulled into the recording medium insertion port 95 while being in sliding contact with the ribs 87 on the inner guide surface 85.

When the recording medium is formed of material of relatively low flexibility (for example, thick paper or postcards), when the leading edge of the recording medium is pulled toward the front of the registration roller 93, the recording medium is shifted toward the inner arcuate guide 14. However, before taking the posture extending along the inner guiding surface 85, as shown by P2 in FIG. 7 for example, the recording medium P2 is shifted to a position closer to the outer arcuate guide 13 than the case of the aforementioned recording medium P1. In other words, the recording medium P2 formed of a material having a low flexibility takes a posture with less curvature in comparison with the case of the recording medium P1 formed of a material having a high flexibility. Then, when the registration roller 93 is rotated from this state, the recording medium P2 is pulled into the recording medium insertion port 95 while taking a free posture according to the various conditions such as a tensile force from the registration roller 93 or the flexibility of the recording medium P2 in the free passage 15.

Here, assuming that a structure in which the recording medium always takes a constant posture (extent of curvature) on the transporting path is employed, when the tensile force or the pushing force is exerted from the transporting unit such as the registration roller or the feeding roller and the like with respect to the recording medium, the recording medium is forced to be bent depending on the material of the recording medium, and hence a load may be applied to the transporting unit. In contrast, according to this embodiment, since the free passage 15 which allows the recording medium to shift in the direction of thickness is provided between the outer arcuate guide 13 and the inner arcuate guide 14, flexibility is provided in posture of the recording medium, and hence the load applied to the transporting unit can be reduced, whereby smooth transportation can be achieved without using the pinch roller or the like. Accordingly, the structure of the apparatus can be simplified, and hence reduction of size and cost can be achieved.

When the recording medium passed through the recording medium insertion port 95 is delivered on the platen 96 by the rotation of the registration roller 93, a predetermined image is recorded on the recording medium on the platen 96 by the recording head 97. Then, the recording medium passed through the platen 96 is transported to the discharge roller 99 toward the front, and is discharged to the upper surface of the overhanging portion 28 of the feeding tray 9 and the upper surface of the cover member 33. In this manner, since the feeding tray 9 also serves as the discharge tray which receives the recording medium discharged from the image recording unit 11, the entire apparatus has a compact structure. Also, since the cover member 33 and the overhanging portion 28 are inclined downwardly toward the rear, the recording medium discharged on the upper surface is prevented from dropping down.

When recording a larger image than the length of the cover member 33 or the overhanging portion 28 such as A4 size, by puling out the auxiliary supporting member 39 in advance, the end of the recording medium hanging from the front end of the cover member 33 can be supported by the auxiliary supporting member 39 whereby the recording medium is prevented from dropping down. When the auxiliary supporting member 39 is not necessary, it can be stored in, thereby being prevented from becoming hindrance.

When the discharged recording medium has a size not running over the front end of the cover member 33, by gripping the end of the recording medium from above and below using the notch 36 formed on the cover member 33, the recording medium can be taken out easily without pulling the feeding tray 9 from the apparatus body 3.

Subsequently, a procedure for attaching and detaching the outer arcuate guide 13 with respect to the apparatus body 3 in case of jamming (clogging of paper) will be described. In order to remove the outer arcuate guide 13, the left and right releasing members 82 and the gripping portions 83 provided on the outer surface (rear surface) of the outer arcuate guide 13 are respectively pinched simultaneously with fingers, and the releasing members 82 are pressed toward the gripping portions 83. Then since the locking portions 80 are bent widthwise inwardly, engagement with respect to the engaged portions 81 is released, the releasing member 82 and the gripping portion 83 are pinched and pulled rearward. Accordingly, engagement of the registration engagement device 76 with respect to the journaled portions 93A of the registration roller 93 is released, and from this state, by further pulling the outer arcuate guide 13, the guide projections 79 come apart from the guiding grooves 77, so that the outer arcuate guide 13 can be removed toward the outside. When the outer arcuate guide 13 is removed from the apparatus body 3, one side of the free passage 15 is opened. Since the free passage 15 is not provided with the member which clamps the recording medium tightly, such as a pinch roller, removal of the jammed recording medium can be performed easily.

When the removed outer arcuate guide 13 is attached to the apparatus body 3 again, the left and right releasing members 82 and the gripping portions 83 are pinched simultaneously with fingers, the releasing members 82 is pressed against toward the gripping members 83, and the outer arcuate guide 13 is inserted into the guide mounting hole 63 from behind. Then, since the outer arcuate guide 13 is guided while engaging the guide projections 79 with the guide grooves 77, the outer arcuate guide 13 is prevented from being inclined. When the outer arcuate guide 13 approaches the adequate mounting position, the journaled portions 93A of the registration rollers 93 enter between the both engaging claws 76A while slightly deforming the pair of engaging claws 76A of the respective registration engagement device 76 outward and are fitted therein. Then, when the fingers are released from the releasing members 82 and the gripping portions 83, the releasing members 82 are restored, and the locking portions 80 engage the engaged portions 81, whereby the outer arcuate guide 13 is locked at the adequate mounting position.

In this manner, by pinching the releasing members 82 and the gripping members 83 simultaneously, the engagement releasing operation of the locking portions 80 and attachment and detachment of the outer arcuate guide 13 can be performed simultaneously, and hence good workability is achieved.

Since the registration engagement device 76 of the outer arcuate guide 13 can be fitted to the rotary shaft of the registration roller 93, the registration accuracy of the outer arcuate guide 13 with respect to the registration roller 93 can be improved. Therefore, the leading edge of the recording medium can be guided accurately to a position clamped by the registration roller 93.

As described above, according to the present embodiment, since the cam portion 60 (swinging unit) is provided on the side end guide 20R for lifting the feeding roller 52 when pulling out and inserting the feeding tray 9, the side wall of the feeding tray 9 can be omitted and width of the feeding tray 9 can be reduced correspondingly, thereby achieving downsizing of the apparatus.

Also, when the feeding tray including the recording media stacked thereon is pulled out, it is necessary to pull the recording media out from the lower side of the feeding roller placed thereon, and when the stacking surface of the feeding tray is a horizontal plane, the recording media may be caught by the feeding roller as the feeding tray is pulled out. In contrast, with the structure of the invention, since the stacking surface 19A of the feeding tray 9 is inclined so that the downstream side (rear side) in the recording medium feeding direction is lower, the recording media is pulled out while coming apart downward from the feeding roller placed on the upper surface thereof when the feeding tray 9 is pulled out. Therefore, the recording medium can hardly be caught by the feeding roller 52, whereby the feeding tray 9 can be pulled out smoothly.

Since the arm member 53 includes the pair of the supporting arms 54, supporting the feeding roller 52, and the power transmitting gear 56 for transmitting the drive force from the support shaft 48 to the feeding roller 52 is incorporated between the supporting arms 54, the structure of the arm member 53 can be downsized.

Since the pair of the side end guides 20R, 20L move via the linear guide bars 23 and the pinion gear 26, good registration workability is achieved.

Since the innermost wall of the feeding tray 9 is formed of the guide plate 43, the leading edge of the recording medium pushed out by the feeding roller 52 is guided upward by the guide plate 43 and supplies to the image recording apparatus 11.

Since a separating member 44 is provided at the protruded center portion of the guide plate 43, the recording medium comes into abutment with the separating member 44 and hence reliably separated.

Since the feeding auxiliary rollers 45 are provided on the separating member 44 at both sides thereof, the recording medium separated by the separating member 44 comes into contact with the roller 45 into the feeding auxiliary roller 45 and hence is transported smoothly.

Since the feeding tray 9 is provided with the fixed side walls 32 at the front portion thereof in addition to the shiftable side end guides 20R, 20L, it is easy to hold by hand. Since the fixed side walls are provided in flush with the side end guides, the width of the feeding tray is not increased.

Since the feeding tray 9 is provided with the cover member 33, so that the feeding tray 9 also serves as a tray for receiving the discharged recording medium, the entire image recording apparatus 1 can be downsized.

Since the cover member 33 is formed with the notch 36 at the widthwise center thereof, the discharged recording medium can easily be picked up.

The discharged recording medium can be prevented from dropping down by pulling the auxiliary supporting member 39 out. When the auxiliary supporting member 39 is not necessary, it can be pushed in, thereby being prevented from becoming hindrance.

As described above, the stacking surface of the feeding tray 9 for the recording media is inclined so that the downstream side in the feeding direction is lower.

Also, the arm member includes a pair of supporting arms provided at both ends of the feeding roller 52 and having bearing portions for receiving the rotary shaft of the feeding roller, and a power transmitting mechanism for transmitting a drive force from the support shaft to the feeding roller is incorporated between the supporting arms.

Further, a pair of the side end guides 20R, 20L are provided at a distance apart from each other in the direction of the width of the recording medium and include linear guide bars extending from the one side end guide toward the other side end guide so as to oppose to each other at a distance apart from each other in the recording medium feeding direction, and including rack gears on the opposing portions thereof, and a pinion gear for engaging the rack gears is rotatably provided on the feeding tray between the linear guide bars.

In addition, the image recording unit 11 is disposed in the apparatus body so as to be located upwardly of the feeding tray, and the innermost wall of the feeding tray includes a guide plate for guiding the leading edge of the recording medium pushed out by the feeding roller upward.

Also, the guide plate is protruded at the widthwise center portion thereof toward the front side with respect to the remaining portion, and is provided at the protruded end thereof with a separating member 44 for separating the recording media supplied in stack.

Additionally, rotatable feeding auxiliary rollers 45 are provided on the guide plate at widthwise ends of the separating member.

Moreover, the feeding tray 9 is provided at the front portion thereof with a pair of fixed side walls aligned in flush with the side end guides when the distance between the side end guides are expanded to the maximum width.

Further, the fixed side walls 32 are provided at the upper ends thereof with a cover member extended therefrom for covering the recording media stacked on the feeding tray and being capable of supporting the recording medium delivered from the image recording unit.

In addition, the cover member 33 is formed at the widthwise center thereof with a notch opening forward.

Also, an auxiliary supporting member 39 is provided in front of the feeding tray so as to be capable of drawing out.

When pulling out the feeding tray 9 including the recording media stacked thereon is pulled out from the apparatus body 3, it is necessary to pull the recording media out from the lower side of the feeding roller placed on the upper surface thereon, and when the stacking surface of the feeding tray is provisionally a horizontal plane, the recording media may be caught by the feeding roller as the feeding tray is pulled out. In contrast, with the structure of the invention, since the stacking surface of the feeding tray is inclined so that the downstream side (rear side) in the recording medium feeding direction is lower, the recording media is pulled out while coming apart downward from the feeding roller placed on the upper surface thereof when the feeding tray is pulled out. Therefore, the recording medium can hardly be caught by the feeding roller, whereby the feeding tray can be pulled out smoothly.

Since the arm member includes the pair of the supporting arms, and the power transmitting mechanism for transmitting the drive force from the support shaft to the feeding roller 52, incorporated between the supporting arms, the structure of the arm member can be downsized.

Since the pair of the side end guides 20R, 20L move via the linear guide bars and the pinion gear, good registration workability is achieved.

Since the innermost wall of the feeding tray 9 is formed of the guide plate, the leading edge of the recording medium pushed out by the feeding roller is guided upward by the guide plate.

Since the guide plate 43 is provided with a separating member at the protruded end thereof, the recording medium comes into abutment with the separating member and hence reliably separated.

Since the feeding auxiliary rollers 45 are provided on the separating member at both sides thereof, the recording medium separated by the separating member comes into contact with the feeding auxiliary roller and hence is transported smoothly.

Since the feeding tray is provided with the fixed side walls 32 at the front portion thereof in addition to the shiftable side end guides, it is easy to hold by hand. Since the fixed side walls are aligned in substantially flush with the side end guides, the width of the feeding tray is not increased.

Since the feeding tray 9 is provided with the cover member, so that the feeding tray also serves as a tray for receiving the discharged recording medium, the entire apparatus can be downsized.

Since the cover member 33 is formed with the notch at the widthwise center thereof, the discharged recording medium can easily be picked up.

The discharged recording medium can be prevented from dropping down by pulling the auxiliary supporting member 39 out. When the auxiliary supporting member is not necessary, it can be pushed in, thereby being prevented from becoming hindrance.

Figure 13A:
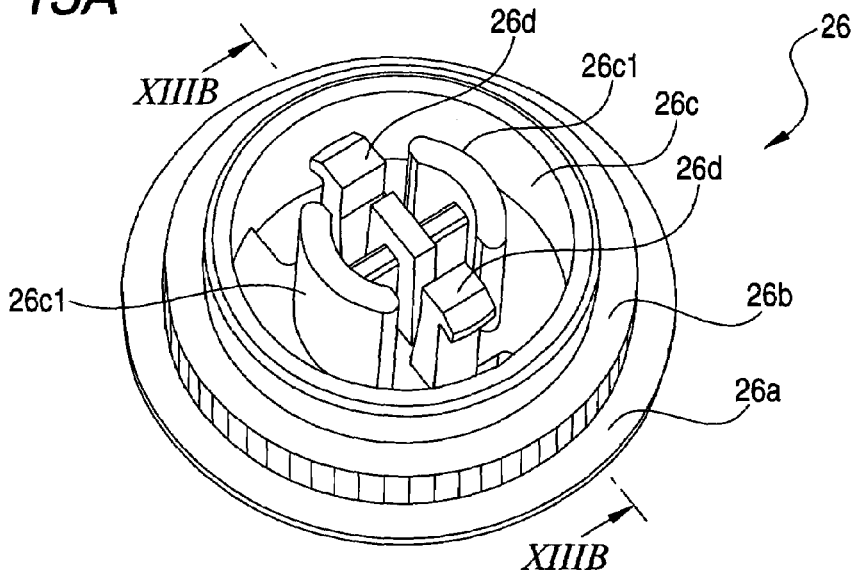
FIG. 13A is a perspective view showing a pinion gear.
Figure 13B:
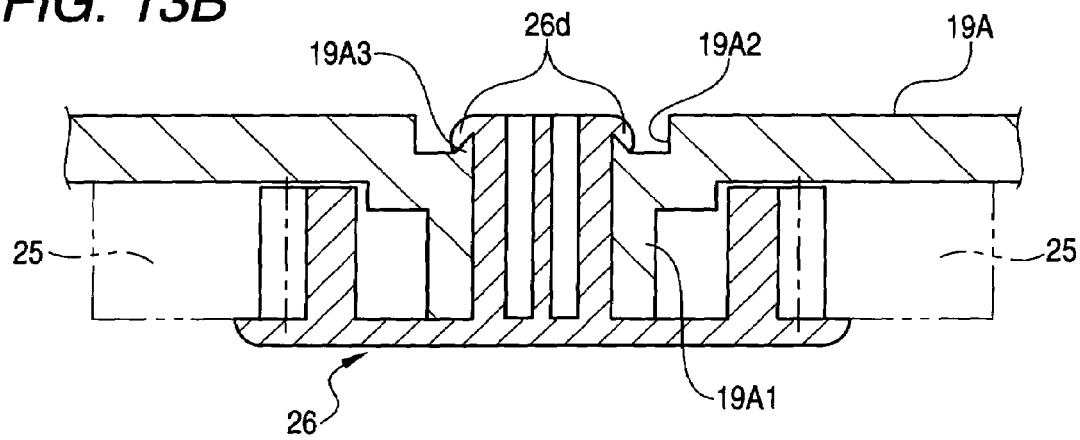
FIG. 13B is a sectional view taken along line XIIIB-XIIIB in FIG. 13A.

As shown in FIGS. 13A and 13B, the pinion gear 26 in this embodiment has a circular base plate 26*a*, a cylindrical gear 26*b* disposed on the base plate 26*a* and on outer circumference of which a gear is formed, s sliding contact portion 26*c* and a pair of engaging claws 26*d* which are disposed in the gear 26*b*. The sliding contact portion 26*c* has a pair of arcuate walls 26c1 that are opposed to each other. The pair of engaging claws 26d are located between the circumferential ends of the arcuate walls 26c1.

As shown in FIG. 13B, the rear stacking surface 19A of the feeding tray 9 is formed with a cylindrical receiving portion 19A1 in which the pair of engaging claws 26d and the arcuate walls 26c1 are inserted. The receiving portion 19A1 projects downward from the rear stacking surface 19A of the feeding tray 9. A recess 19A2 that communicates with an inner hole of the cylindrical receiving portion 19A1 is formed on an upper surface of the rear stacking surface 19A. A circumferential projection 19A3 is formed on an upper rim of the inner hole with which the engaging claws 26d engage to fix the pinion gear 26 to the feeding tray 9. The pinion gear 26 is rotated in accordance with the movement of the rack gears 25 (refer to FIG. 3). The arcuate walls 26c1 are in sliding contact with an inner surface of the receiving portion 19A1.

Figure 13C:
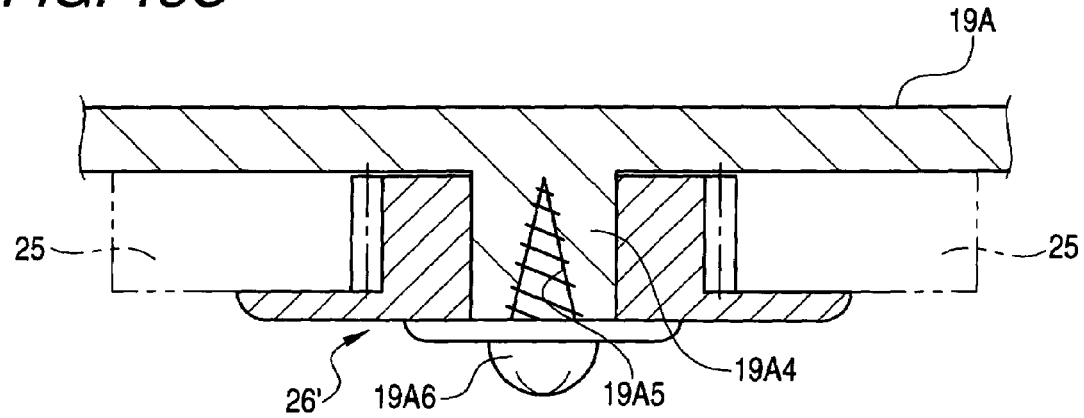
FIG. 13C is a sectional view showing a related art.

In a related art, a pinion gear 26' is mounted to the feeding tray 9 by a screw 19A6 as shown in FIG. 13C. The rear stacking surface 19A of the feeding tray 9 is formed with a boss 19A4 that has a screw hole 19A5. In this way, the pinion gear 26' is firmly fixed to the feeding tray 9 in a rotatable manner so that coming off of the pinion gear 26' from the feeding tray 9 is prevented. However, the whole height of this structure is relatively large because of the existence of the screw 19A6. Also, an assembly step for screwing with a suitable screwing torque is required. If the screwing torque is too high, cracks are formed in the boss 19A4.

In the embodiment as shown in FIGS. 13A and 13B, since the screw is eliminated, the height of the structure is reduced and the assembly step for screwing is omitted.

Figure 14A:
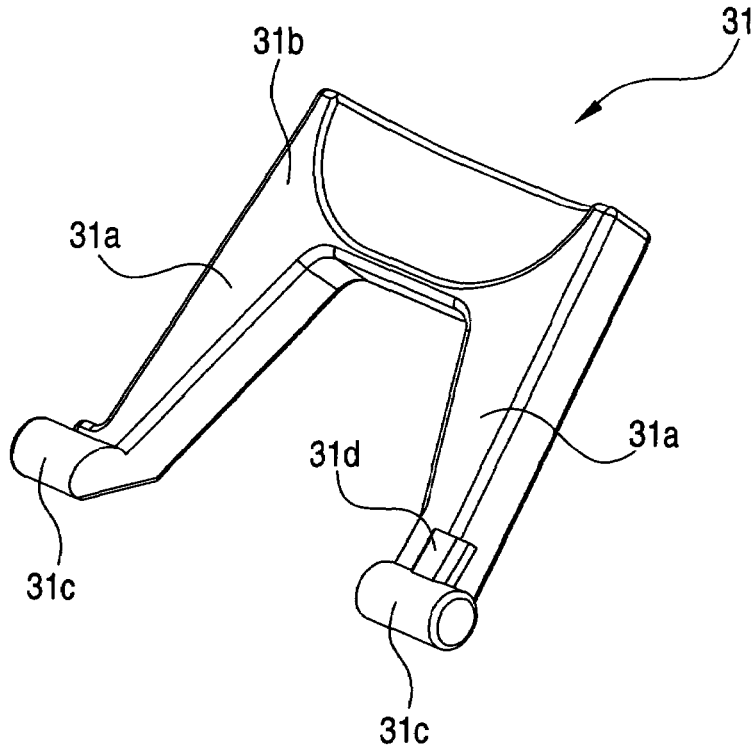
FIG. 14A is a perspective view of a registration rib.
Figure 14B:
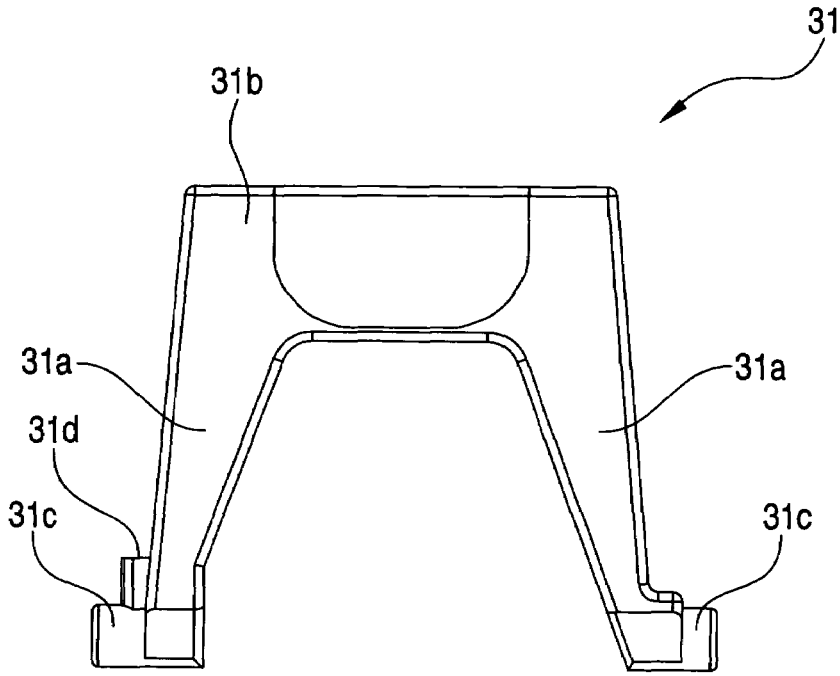
FIG. 14B is a view seen from a direction of arrow XIVB in FIG. 14A.

As shown in FIGS. 3 and 4, the feeding tray 9 of this embodiment has the pair of registration ribs 31 on its rear stacking surface 19A which support the ends of small-sized recording media stacked on the feeding tray 9, when those registration ribs 31 are rotated to stand on the rear stacking surface 19A. Each of the registration ribs 31 is formed, as shown in FIGS. 14A and 14B, to have a pair of legs 31a, a lateral portion 31b that connects top ends of the legs 31a, rotational axles 31c that are formed on bottom ends of the legs 31a, respectively, and a stopper 31d formed on one of the legs 31a. The stopper 31d is laterally projecting from the leg 31a to a small extent, and is engagable with a shallow recess (not shown) formed on the rear stacking surface 19A of the feeding tray 9.

Figure 15A:
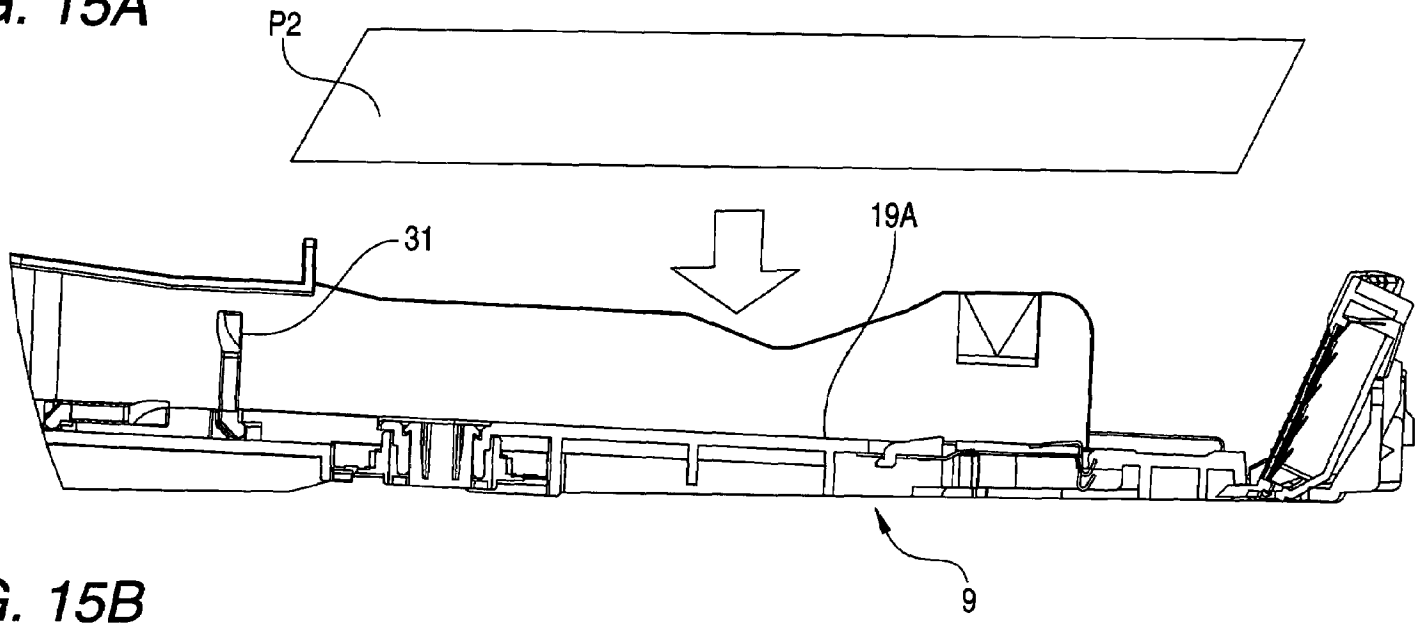
FIGS. 15A and 15B are schematic side views of the feeding tray.
Figure 15B:
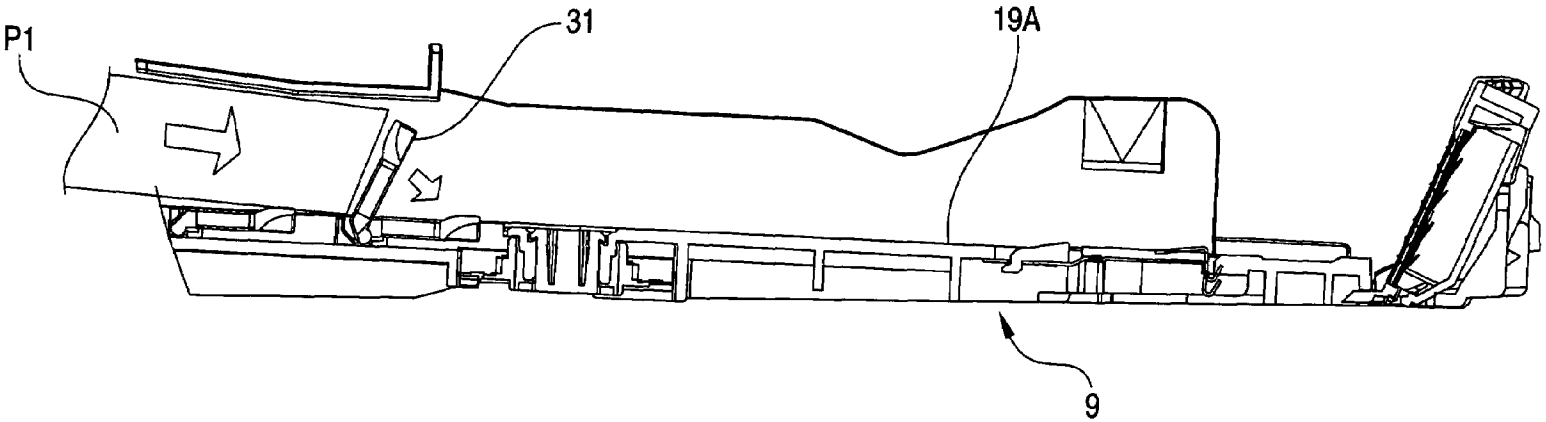

As shown in FIG. 15A, when the registration rib 31 stands on the rear stacking surface 19A of the feeding tray 9, a small-sized recording medium P2 can be set from the above in a state where the feeding tray 9 is drawn out of the image recording apparatus 1. The stopper 31d of the registration rib 31 is engaged with the shallow recess of the rear stacking surface 19A in this state. Subsequently, when a large-sized recording medium P1 such as the A4-sized sheet is to be set on the feeding tray 9, the large-sized recording medium P1, as shown in FIG. 15b, can be inserted from the front side into the feeding tray 9. Since the engagement between the stopper 31d of the registration rib 31 and the shallow recess of the rear stacking surface 19A is not so firm, the insertion end of the recording medium P1 can easily fold down the standing registration rib 31. Therefore, the user do not need to fold down the registration rib 31 by figures.

Figure 16A:
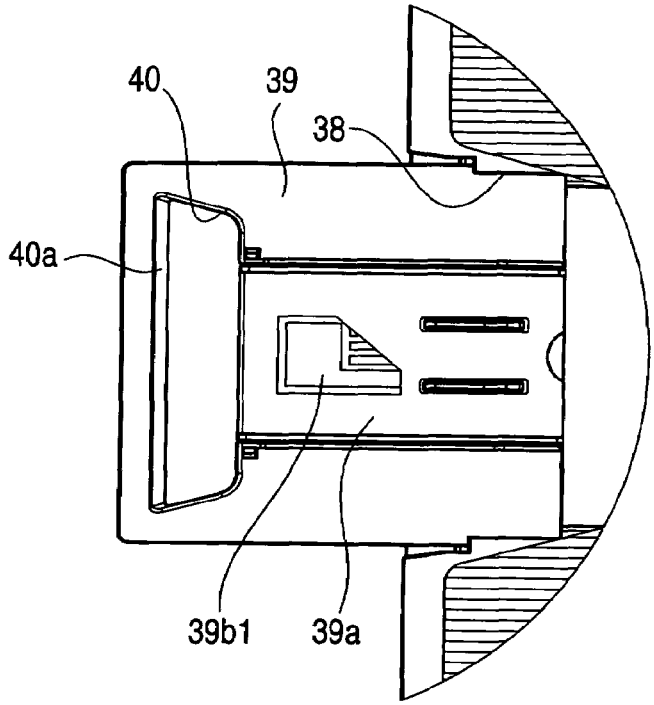
FIGS. 16A and 16B are plan views of an auxiliary supporting member.

FIG. 16A shows the enlarged plan view of the plate-shaped auxiliary supporting member 39 in a state where the auxiliary supporting member 39 is pulled out from the supporting member storage hole 38 opening toward the front. The finger hole 40 formed at the front portion of the auxiliary supporting member 39 is relatively long in the width direction of the recording medium. An inclined surface 40a is formed on the front rim of the finger hole 40 which extends over the entire width of the finger hole 40. This inclined surface 40a effectively prevents the leading end of the recording medium discharged from the image recording unit 11 from being caught by the front rim of the finger hole 40. Therefore, jam and damage of the recording medium is surely prevented. Also, the pulling and inserting operation of the auxiliary supporting member 39 by the user is facilitated.

Figure 16B:
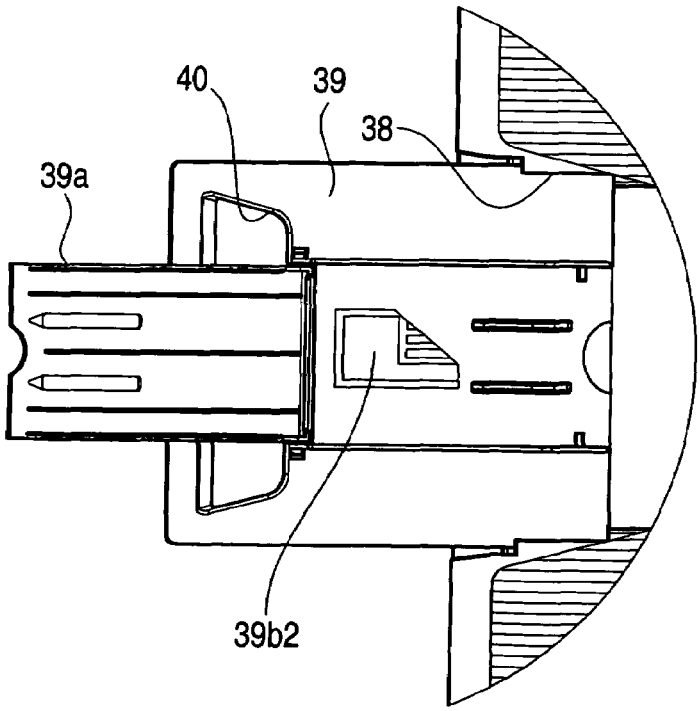

On the auxiliary supporting member 39, a rotatable extension guide 39a is provided. FIG. 16B shows a state where the extension guide 39a is rotated forward to receive a large-sized recording medium discharged from the image recording unit 11. On an upper surface of the auxiliary supporting member 39, a mark 39b2 that shows which surface of the recording medium set on the feeding tray 9 becomes a printing surface is provided. This mark 39b2 indicates that a lower surface of the recording medium set on the feeding tray 9 becomes the printing surface. Further, as shown in FIG. 16A, another mark 39b1 is provided on an upper surface of the extension guide 39a in a state where the extension guide 39a is returned. This mark 39b1 also indicates that a lower surface of the recording medium set on the feeding tray 9 becomes the printing surface. In this state as shown in FIG. 16A, the mark 39b2 shown in FIG. 16B is covered by the extension guide 39a. Incidentally, both marks 39b1 and 39b2 are positioned to be visible when the auxiliary supporting member 39 is pulled out from the supporting member storage hole 38 as shown in FIGS. 16A and 16B, so that the recording medium set on the feeding tray does not cover the marks 39b1 and 39b2.

In a related art, the mark 39b2 on the auxiliary supporting member 39 shown in FIG. 16B is not provided. In this case, when the extension guide 39a is rotated forward as shown in FIG. 16B, since the mark on the extension guide 39a, which is upside-down, cannot be seen by the user, there is a possibility that the user mistakenly set the recording medium assuming that the upper surface of the recording medium becomes the printing surface. According to the embodiment shown in FIGS. 16A and 16B, since the mark 39b2 on the auxiliary supporting member 39 is visible even when the extension guide 39a is rotated forward, such a mistake is surely prevented.

Figure 17A:
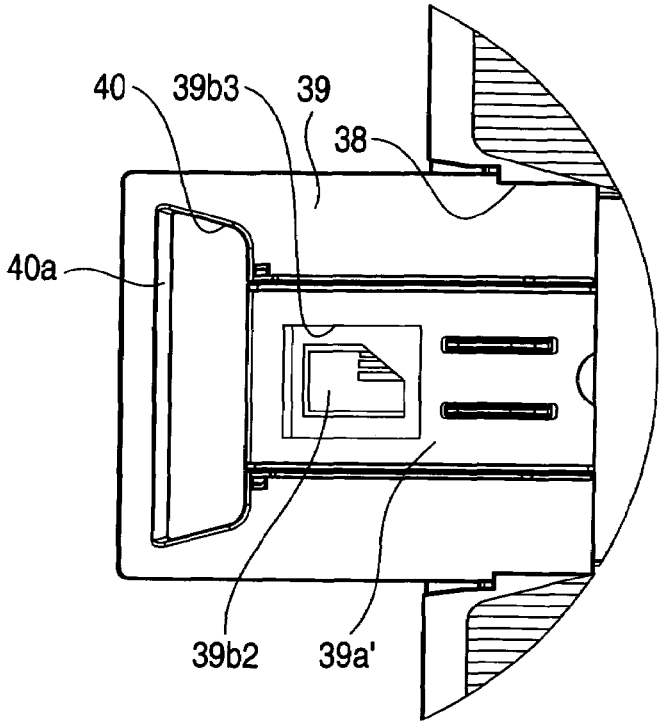
FIGS. 17A and 17B are plan views of a modified auxiliary supporting member.
Figure 17B:
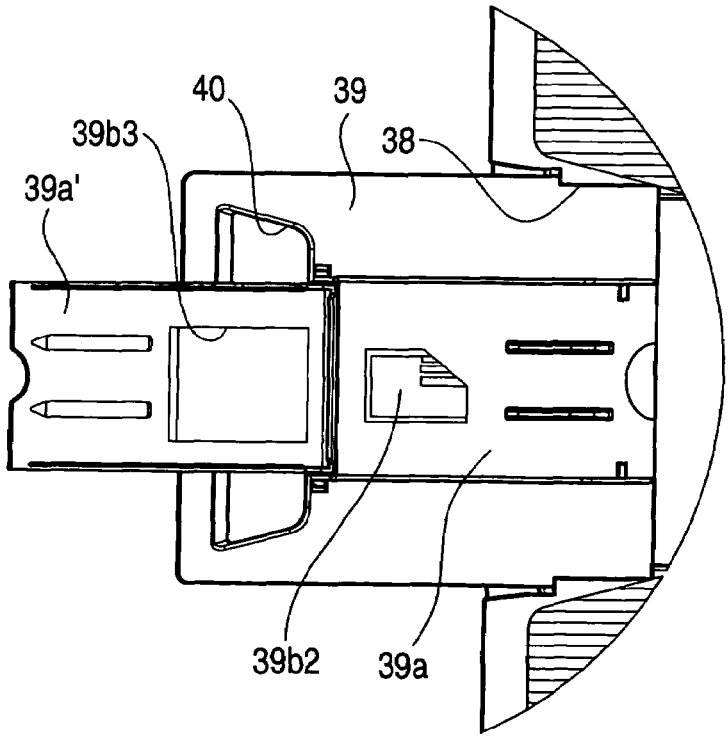

FIGS. 17A and 17B show a modified example. As shown in FIG. 17B, an extension guide 39a' of this example has a through hole 39b3. Therefore, even when the extension guide 39a' is returned as shown in FIG. 17A, the mark 39b2 provided on the auxiliary supporting member 39b2 is visible through the through hole 39b3.

The invention is not limited to the embodiment described based on the description and drawings shown above, and the following embodiments are also included within the scope of the invention. Also, in addition to those shown below, various modifications can be made without departing the scope of the invention. (1) In the aforementioned embodiment, an example in which the feeding tray is attachable and detachable with respect to the apparatus body is shown. However, the present invention can also be applied to the feeding tray which can be pulled out from the apparatus body but cannot be removed from the apparatus body. In other words, the present invention can be applied as long as the major part of the feeding tray can be pulled out from the apparatus body and, after having replenished the recording media to the feeding tray, the feeding tray can be inserted again into the apparatus body. Therefore, the feeding tray which can be pulled out from and inserted into the apparatus body includes not only the feeding tray which can be attached to and detached from the apparatus body, but also the feeding tray which cannot be attached and detached.

What is claimed is:

1. An image recording apparatus comprising:

an apparatus body having a support shaft;

a feeding tray being capable of accommodating a sheet-type recording medium stacked thereon and capable of being pulled out from and inserted into the apparatus body;

a side end guide provided on the feeding tray along a recording medium feeding direction and shiftable relative to the feeding tray in a direction orthogonal to the recording medium feeding direction;

an image recording unit provided in the apparatus body for recording an image on the recording medium;

an arm member capable of swinging about the support shaft extending in the apparatus body in the direction orthogonal to the recording medium feeding direction;

a feeding roller disposed on a swinging end side of the arm member and coming into abutment with an uppermost recording medium stacked on the feeding tray when the feeding tray is inserted into the apparatus body and transporting the same toward the image recording unit;

a cam portion provided on the side end guide and having a height from a bottom surface of the feeding tray which varies along the recording medium feeding direction; and a driven portion provided on the arm member, the driven portion being brought into slide contact with the cam portion and displaced when the feeding tray is pulled out from or inserted into the apparatus body to cause a swing movement of the arm member.

2. The image recording apparatus according to claim 1, wherein the driven portion is integrally provided with the arm member.

3. The image recording apparatus according to claim 1, wherein the feeding roller climbs over an innermost wall of the feeding tray in accordance with the swing movement of the arm member, the innermost wall being disposed on a downstream side in the recording medium feeding direction.

4. The image recording apparatus according to claim 1, wherein a stacking surface of the feeding tray on which the recording medium is stacked is inclined in a manner that a downstream side of the stacking surface in the recording medium feeding direction becomes low.

5. The image recording apparatus according to claim 1, wherein the arm member comprises:

a pair of supporting arms provided at both ends of the feeding roller and having bearing portions for receiving a rotary shaft of the feeding roller; and a power transmitting mechanism for transmitting a drive force from the support shaft to the feeding roller, the power transmitting mechanism being disposed between the supporting arms.

6. The image recording apparatus according to claim 1, wherein the side end guide comprises a pair of side end guides that are disposed at a distance apart from each other in a width direction of the recording medium and include linear guide bars extending from one side end guide toward the other side end guide, the linear guide bars opposing to each other at a distance apart from each other in the recording medium feeding direction and having rack gears on opposing portions thereof; and a pinion gear for engaging the rack gears is rotatably provided on the feeding tray between the linear guide bars.

7. The image recording apparatus according to claim 3, wherein the image recording unit is located upward of the feeding tray in the apparatus body; and the innermost wall of the feeding tray comprises a guide plate for guiding a leading edge of the recording medium pushed out by the feeding roller upward.

8. The image recording apparatus according to claim 7, wherein the guide plate is protruded at a widthwise center portion thereof toward a front side, and is provided at a protruded end thereof with a separating member for separating the recording media supplied in stack.

9. The image recording apparatus according to claim 8, further comprising rotatable feeding auxiliary rollers provided on the guide plate at both sides with respect to the separating member.

10. The image recording apparatus according to claim 6, wherein the feeding tray comprises fixed side walls provided at a front portion thereof the fixed side walls becoming flush with the side end guides when a distance between the side end guides is expanded to a maximum width.

11. The image recording apparatus according to claim 10, further comprising a cover member disposed on the fixed side walls for covering the recording medium stacked on the feeding tray from above, the cover member being capable of supporting the recording medium transported from the image recording unit.

12. The image recording apparatus according to claim 11, wherein the cover member is formed at a widthwise center thereof with a notch opening forward.

13. The image recording apparatus according to claim 11, further comprising an auxiliary supporting member on a front side of the feeding tray, the auxiliary supporting member being capable of drawing out forward.

14. A feeding tray used for an image recording apparatus having a main body and a feeding roller swingable about a support shaft, the feeding tray being capable of drawing out from and inserting into the main body and being capable of accommodating a plurality of sheet-type recording media stacked on a stacking surface, the feeding tray comprising:

a side end guide provided along a recording medium feeding direction and shiftable relative to the stacking surface in direction orthogonal to the recording medium feeding direction; and a swinging unit provided on the side end guide for swinging the feeding roller when the feeding tray is pulled out from or inserted into the apparatus body.

15. The feeding tray according to claim 14, wherein the swinging unit comprises a cam portion at an upper end of the side end guide, the cam portion having a height from a bottom surface of the feeding tray which varies along the recording medium feeding direction.

16. The feeding tray according to claim 14, wherein the stacking surface of the feeding tray on which the recording medium is stacked is inclined in a manner that a downstream side of the stacking surface in the recording medium feeding direction becomes low.

17. The feeding tray according to claim 14, wherein the side end guide comprises a pair of side end guides that are disposed at a distance apart from each other in a width direction of the recording medium and include linear guide bars extending from one side end guide toward the other side end guide, the linear guide bars opposing to each other at a distance apart from each other in the recording medium feeding direction and having rack gears on opposing portions thereof; and a pinion gear for engaging the rack gears is rotatably provided on the feeding tray between the linear guide bars.

18. The feeding tray according to claim 14, wherein an innermost wall of the feeding tray comprises a guide plate for guiding a leading edge of the recording medium pushed out by the feeding roller upward.

19. The feeding tray according to claim 18, wherein the guide plate is protruded at a widthwise center portion thereof toward a front side, and is provided at a protruded end thereof with a separating member for separating the recording medium supplied in stack.

20. The feeding tray according to claim 17, further comprising a pair of fixed side walls at a front portion thereof, the fixed side walls becoming flush with the side end guides when a distance between the side end guides is expanded to a maximum width.

21. The image recording apparatus according to claim 1, wherein the arm member is mounted to the end of the support shaft and being located at a widthwise center of an end of the feeding tray.

22. The image recording apparatus according to claim 1, further comprising:

a pair of supporting arms, wherein the driven portion has a plate shape, which is flush with the lower end surface of said pair of supporting arms.

23. The image recording apparatus according to claim 1, wherein the side end guide is configured to shift between a first position and a second position, wherein, when the side end guide is positioned at the first position and the second position, the driven portion is brought into slide contact with the cam portion and displaced when the feeding tray is pulled out from or inserted into the apparatus body to cause a swing movement of the arm member.

24. The feeding tray according to claim 14, wherein the feeding tray is used for the image recording apparatus that further comprises:

an arm member capable of swinging about the support shaft extending in the main body in the direction orthogonal to the recording medium feeding direction; and a driven portion provided on the arm member, wherein the side end guide is configured to shift between a first position and a second position, wherein, when the side end guide is positioned at the first position and the second position, the driven portion is brought into slide contact with the swinging unit and displaced when the feeding tray is pulled out from or inserted into the main body to cause a swing movement of the arm member.

* * * * *